US007152320B2

(12) United States Patent
Abe et al.

(10) Patent No.: US 7,152,320 B2
(45) Date of Patent: Dec. 26, 2006

(54) ROCKER ARM AND METHOD OF MANUFACTURING THE ROCKER ARM

(75) Inventors: Shiyouichi Abe, Gunma (JP); Kiyoshi Ookubo, Gunma (JP); Yasushi Watanabe, Gunma (JP); Takanori Ooshima, Gunma (JP)

(73) Assignees: NSK Ltd., Tokyo (JP); NSK Steering Systems Co., Ltd., Tokyo (JP)

( * ) Notice: Subject to any disclaimer, the term of this patent is extended or adjusted under 35 U.S.C. 154(b) by 0 days.

(21) Appl. No.: 11/294,671

(22) Filed: Dec. 5, 2005

(65) Prior Publication Data

US 2006/0137637 A1 Jun. 29, 2006

Related U.S. Application Data

(63) Continuation of application No. PCT/JP04/07494, filed on May 31, 2004.

(30) Foreign Application Priority Data

Jun. 6, 2003 (JP) ..... 2003-161583
Jun. 6, 2003 (JP) ..... 2003-162655
Jun. 12, 2003 (JP) ..... 2003-168250

(51) Int. Cl.
*B21D 53/84* (2006.01)

(52) U.S. Cl. ..... 29/888.2; 29/DIG. 18; 29/DIG. 47; 123/90.39; 123/90.41; 123/90.44; 123/90.45; 74/559; 74/569

(58) Field of Classification Search ..... 29/888.2
See application file for complete search history.

(56) References Cited

U.S. PATENT DOCUMENTS 5,251,585 A * 10/1993 Graber ..... 123/90.39
6,334,416 B1 * 1/2002 Okubo et al. ..... 123/90.42
6,729,285 B1 * 5/2004 Ammon et al. ..... 123/90.39

FOREIGN PATENT DOCUMENTS

JP 1-91931 4/1989
JP 4-214912 8/1992

(Continued)

OTHER PUBLICATIONS

International Search Report dated Aug. 24, 2004.

(Continued)

*Primary Examiner*—Thomas Denion
*Assistant Examiner*—Kyle M. Riddle
(74) *Attorney, Agent, or Firm*—Katten Muchin Rosenman LLP

(57) ABSTRACT

In relation to a rocker arm obtained by applying cold forging to a blank made from a metal wire rod, cold forging is applied to a blank obtained by cutting a metal wire rod to a predetermined length to make a second intermediate blank 34*b* having a pair of side wall sections 2*a* and a base 39 which connects the two side walls 2*a* at one of their respective widthwise edges. Punching is applied to the base 39 of this second intermediate blank 34*b* to form a first and a second connection sections. In the case where it is assumed that a roller 35 is arranged at a position corresponding to an arrangement position of the roller 35 of the rocker arm to be obtained, on the inside of the second intermediate blank 34*b* which is to be subjected to punch processing, the roller 35 and the base 39 do not interfere with each other. As a result, performance improvement of an engine fitted with this rocker arm is obtained.

9 Claims, 18 Drawing Sheets

FOREIGN PATENT DOCUMENTS

| | | |
|---|---|---|
| JP | 5-321616 | 12/1993 |
| JP | 6-159018 | 6/1994 |
| JP | 10-328778 | 12/1998 |
| JP | 2000-71046 | 3/2000 |
| JP | 2000-140979 | 5/2000 |
| JP | 2001-47179 | 2/2001 |
| JP | 2003-1362 | 1/2003 |

OTHER PUBLICATIONS

International Preliminary Report on Patentability dated May 1, 2006.

* cited by examiner

ROCKER ARM AND METHOD OF MANUFACTURING THE ROCKER ARM

CROSS-REFERENCE TO RELATED APPLICATION

This application is a continuation of International Application PCT/JP2004/007494 filed on May 31, 2004, pending at the time of filing of this continuation application and claims priority from Japanese Patent Application 2003-162655 filed Jun. 6, 2003, Japanese Patent Application 2003-161583 filed Jun. 6, 2003 and Japanese Patent Application 2003-168250 filed Jun. 12, 2003, the contents of which are herein wholly incorporated by reference

TECHNICAL FIELD

The present invention relates to a rocker arm constituting a cam follower incorporated into a valve operating mechanism of an engine, for converting rotation of a cam shaft into reciprocating motion of a valve body (intake valve and exhaust valve), and a method of manufacturing the rocker arm.

BACKGROUND ART

In a reciprocating engine (a reciprocating piston engine) except for some 2-cycle engines, there are provided intake valves and exhaust valves that open and close in synchronization with the rotation of the crank shaft. In this kind of reciprocating engine, the movement of the cam shaft that rotates in synchronization with the rotation of the crank shaft (½ the rpm in the case of a 4-cycle engine) is transmitted to the intake valves and the exhaust valves by rocker arms, and causes the intake valves and exhaust valves to move in a reciprocating motion in the axial direction thereof.

Conventionally, castings (iron castings or aluminum die-castings) were used for the rocker arm assembled into the valve operating mechanism of this kind of engine. Furthermore, in recent years, manufacturing the rocker arm by press-processing a metal plate such as a steel plate, has been consider d, and is being performed to some extent. However, in the case of the rocker arm of such a casting or the rocker arm made from a metal plate, the time required for the fabricating operation is long, and waste of material is significant, so that there is a problem of an increase in cost.

To address this, as disclosed in Japanese Patent Application Publication No. H10-328778, a method of manufacturing a rocker arm has been proposed wherein cold forging is applied to a blank obtained by cutting a metal wire rod to a predetermined length. According to Japanese Patent Application Publication No. H10-328778, in the case of making the rocker arm by applying cold forging to the blank made from a metal wire rod, this can be made to high accuracy without the occurrence of cracking, so that work efficiency can be favorable. Moreover, in the case where the rocker arm is made by this cold forging, then compared to the case where this is made by hot forging, the form accuracy and the dimensional accuracy can be increased. FIG. 22 to FIG. 28 illustrate an invention related to the method of manufacturing a rocker arm disclosed in Japanese Patent Application Publication No. H10-328778. This rocker arm manufacturing method is described in detail in Japanese Patent Application Publication No. H10-328778, and hence is only briefly described here. As shown in FIG. 22, a rocker arm 1 has a pair of side wall sections 2 that are nearly parallel with each other, and a first connecting section 3 and a second connecting section 4 that connect the lengthwise opposite ends of the two side wall sections 2. Of these first connecting section 3 and second connecting section 4, the first connecting section 3 has a first engagement section 6 for abutting against the base end of a valve body, and the second connecting section 4 has a second engagement section 7 for abutting against a tip end of a rocking support member such as a lash adjuster.

Furthermore, while not disclosed in Japanese Patent Application Publication No. H10-328778, in the case of the actually used rocker arm, a pair of holes are formed concentric with each other in the lengthwise middle portion of the two side wall sections 2, and opposite ends of a support shaft for rotatably supporting a roller which is engaged with a cam, are freely supported in these two holes.

The operation for making such a rocker arm 1 is carried out as follows. At first, as shown in FIG. 23, an end of a steel wire rod 9 which is wound in a coil on a rotating support apparatus 8, is drawn out by a roller type wire feed mechanism 11 which is provided on a cold forge forming machine 10, and is guided into the cold forge forming machine 10. The cross-section shape of the metal wire rod 9 is rectangular. Furthermore, by previously pickling the metal wire rod 9 in a lubrication liquid tank of a zinc phosphate or the like, a lubricating film layer is formed on the outer surface of the metal wire rod 9. Then, as a first step, as shown in FIG. 24, the metal wire rod 9 is cut to a predetermined length in a cutting mechanism 12 provided in the cold forge forming machine 10, to thereby make a blank 13 of a rectangular solid. The cold forge forming machine 10 is referred to as a horizontal multistage forging forming machine, and comprises a die block 14 secured to the inside, and a ram 15 which reciprocates in the horizontal direction so as to approach and separate (move apart and close) with respect to the die block 14. In the die block 14, a plurality of fixed dies 16*a* to 16*d* are arranged spaced apart in the horizontal direction. Furthermore, on part of the ram 15, facing the fixed dies 16*a* to 16*d*, a plurality of moveable dies 17*a* to 17*d* are arranged through the medium of respective die holders 18*a* to 18*d*. At the sections where the fixed dies 16*a* to 16*d* and the moveable dies 17*a* to 17*d* are arranged, there are respectively provided; a first forging station 19, a first punching station 20, a second forging station 21, and a second punching station 22. The rectangular solid blank 13 obtained by the first step is supplied to the first forging station 19 while changing the direction of the blank 13 through 90 degrees, by means of a material rotation feed mechanism 23 provided in the cold forge forming machine 10.

At the first forging station 19, as a second step, as shown in FIG. 25, the blank 13 is subjected to cold forging by punching the blank 13 in the horizontal direction into the fixed die 16*a* by the moveable die 17*a*, to thereby make a first intermediate blank 24 having a rough shape and dimension of the rocker arm 1. This first intermediate blank 24 comprises a pair of side wall sections 2 (FIG. 22) and a base 51 which connects the widthwise middle portions of the two side wall sections 2, giving a cross-section H-shape. A burr 25 is formed around the entire periphery of the first intermediate blank 24 on the outer peripheral face of the thickness direction middle portion. Since previously a lubrication film layer is formed on the outer peripheral face of the blank 13 which has been subjected to this cold forging, the friction acting between the inside face of the fixed die 16*a* and the moveable die 17*a*, and the outside face of the blank 13 is kept to a minimum. Furthermore, by means of this configuration, the forming workability and the shape accuracy of the first intermediate blank 24 can be made good. The first intermediate blank 24 which is made in such a second step is taken out from between the fixed die 16*a* and the moveable die 17*a*, and is supplied to a first punching station 20 as shown in detail in FIG. 26.

In this first punching station 20, as a third step, as shown in FIG. 26, of the first intermediate blank 24, a main body portion except for the burr 25 is clamped between the tip end face of a cylindrical extrusion member 27 provided inside a bore 26 of a fixed die 16*b*, and the tip end face of a cylindrical moveable die 17*b*. Then by extruding the main body portion inside the bore 26, the burr 25 is removed by the rim portion of the open end of the bore 26. Simultaneous with this, the middle portion of the base 51 (FIG. 25) provided on the first intermediate blank 24 is punched by a hole punch 28 provided on the inside of the cylindrical extrusion member 27, to thereby make a second intermediate blank 30 having a hole 29. By forming this hole 29, both the first and second connecting sections 3 and 4 that connect the lengthwise opposite ends of the pair of side wall sections 2 (FIG. 22) are formed on the second intermediate blank 30. The second intermediate blank 30 obtained by this third step is taken out from between the fixed die 16*b* and the moveable die 17*b*, and is supplied to the second forging station 21 as shown in detail in FIG. 27.

In the second forging station 21, as a fourth step, the second intermediate blank 30 is subjected to cold forging by punching the second intermediate blank 30 in the horizontal direction into the fixed die 16*c* by the moveable die 17*c*, to thereby make a third intermediate blank 31 having dimensions and shape close to the finished product. At this time, respective burrs 25*a* and 25*b* are formed on the outer peripheral face of the thickness direction middle portion of the third intermediate blank 31, and the inner peripheral face of the hole 29. In carrying out this cold forge forming, since the lubrication film layer is formed beforehand on the outer face of the second intermediate blank 30, the friction acting between the inner face of the fixed die 16*c* and the movable die 17*c*, and the outer face of the second intermediate blank 30 is kept to a minimum. By means of this configuration, the forming workability and the form accuracy of the third intermediate blank 31 can be made good. Once this fourth step is completed, the third intermediate blank 31 is taken out from between the fixed die 16*c* and the movable die 17*c*, and this third intermediate blank 31 is supplied to the second punching station 22 as shown in detail in FIG. 28.

At the second punching station 22, as a fifth step, as shown in FIG. 28, similar to the case of the third step, the burr 25*a* formed on the outer peripheral face of the third intermediate blank 31 is removed. Simultaneous with this, the burr 25*b* formed on the inner peripheral face of the hole 29 of the third intermediate blank 31 is also removed, to thereby give the finished product of the rocker arm 1. This rocker arm 1 is taken out to a predetermined position, from between the fixed die 16*d* and the moveable die 17*d* of the second punching station 22 by, for example, an ejection chuck (not shown in the figure). Furthermore, although not disclosed in Japanese Patent Application Publication No. H10-328778, in the case of the actually used rocker arm, a separate processing machine is used to carry out a hole forming process in order to form a pair of circular holes at mutually matching positions in the middle portions of the respective side wall sections 2 (FIG. 22).

When the rocker arm 1 is manufactured by the multistage cold forging machine as with the method of manufacturing a rocker arm disclosed in Japanese Patent Application Publication No. H10-328778, the time required for the manufacturing operation can be shortened to some extent, so that work efficiency can be made good, thus facilitating a reduction in the cost of the rocker arm 1. Furthermore, in the manufacturing method, since the movable dies 17*a* to 17*d* are moved in the horizontal direction, then compared to the case where the forging operation is carried out by moving the movable dies in the vertical direction, the load applied to the drive mechanism for moving the movable dies 17*a* to 17*d* back and forth can be reduced. Therefore, speeding up of the cold forging operation for obtaining the rocker arm 1 can be facilitated.

However, in the rocker arm disclosed in Japanese Patent Application Publication No. H10-328778, and the manufacturing method therefor, there is further room for improvement in the following points.

(1) The hole 29 which is formed by applying the punching process to the first intermediate blank 24 in order to provide the first and second connecting sections 3 and 4, is located at the approximately middle portion in relation to the widthwise direction of the pair of side wall sections 2. Moreover, since this hole 29 is formed by the punching process, the inside peripheral face thereof becomes a rough sheared face (fractured face). Therefore, in a condition where the cam follower is constructed by assembling the roller into the rocker arm 1, the opposite end faces of the roller are likely to come in contact with this sheared face (fractured face). When in this manner the opposite end faces of the roller come in contact with the sheared face (fractured face), it is difficult to smoothly rotate the roller, thus becoming an impediment to performance improvement of an engine incorporating the rocker arm 1. Furthermore, in the case where the opposite end faces of the roller come in contact with the sheared face (fractured face), the opposite end faces of the roller are abnormally worn, and abrasion powder which is produced by wear at the contact portion enters into the space between the component members of the engine, so that there is a likelihood of performance deterioration of the engine.

(2) There is still room for improvement from the point of weight lightening. That is, in the case of the rocker arm 1 disclosed in Japanese Patent Application Publication No. H10-328778, a starting position P of one lengthwise end rim (the lower end rim in FIG. 22) of the side wall sections 2 on one side (the left side in FIG. 22(*a*)) of the first connecting section 3 is close to the one lengthwise end rim (the lower end rim in FIG. 22) of the rocker arm 1. Therefore, the lengthwise dimension of the side wall sections 2 becomes large, so that the volume of the rocker arm 1 becomes unnecessarily bulky, becoming a cause of increase in the weight of the rocker arm 1. When in this manner the weight of the rocker arm 1 is increased, this becomes a cause of a drop in performance, such as the output performance, of an engine having this rocker arm 1.

(3) In both of the second and fourth steps which are forging processes for obtaining the rocker arm 1, the cold forging operation is applied to the blank 13 (or the second intermediate blank 30) by pressing the rectangular solid blank 13 (or the second intermediate blank 30) from opposite sides in the perpendicular direction (the thickness direction of the base 51 or the connecting sections 3, 4) with respect to the axial direction (lengthwise direction), being mutually the same directions. Therefore, in the second and fourth steps, excessive stress is likely to concentrate in one part of the blank 13 and the second intermediate blank 30 which corresponds to the same portion of the obtained rocker arm 1, so that in the obtained rocker arm 1, it is difficult to sufficiently maintain the strength.

Furthermore, the blank 13 is a rectangular solid, and the cross-section area in relation to the axial direction (lengthwise direction) is the same. On the other hand, in the second intermediate blank 30, the cross-section area in the axial direction is not uniform (changes significantly). Therefore, the second intermediate blank 30 cannot be obtained by directly cold forging from the blank 13. The second intermediate blank 30 must be made by cold forging the first intermediate blank 24 with the accompanying burr 25, and then removing this burr 25 in a subsequent punching process.

When the cold forging operation is carried out in this manner with the accompany burr 25, the fiber flow, which is the flow of the internal fibrous structure, of the second intermediate blank 30, is newly created along the flow direction of the burr 25. Together with this, the fiber flow formed in the original first intermediate blank 24 is disturbed at the burr 25 portion and becomes discontinuous. Moreover, by removing the burr 25 in a subsequent process, the fiber flow of this portion is parted (cut). If the fiber flow is parted in this way, the strength of the finished product (article) of the obtained rocker arm 1 tends to decrease. Furthermore, when the burr is parted, a sheared face or fractured face accompanying this is produced, so that there is a possibility of defects occurring. Moreover, this becomes a cause of deterioration in form accuracy. Also, since the forging load is increased, equipment having a large forging capacity is necessary. Furthermore, material loss is naturally increased due to the burr 25, becoming a cause of an increase in cost.

In the case of the method of manufacturing a rocker arm disclosed in Japanese Patent Application Publication No. H10-328778, the same operation is repeated in the fourth and fifth steps. That is, after executing cold forging with the accompanying burrs 25*a* and 25*b*, these burrs 25*a* and 25*b* are removed. Therefore a drop in strength and deterioration in precision of the product is likely to occur even more.

Furthermore, of the burrs 25, 25*a*, and 25*b* formed accompanying the cold forging, the burrs (outer burrs) 25 and 25*a* which occur on the outer peripheral side are formed on the surroundings, and hence the volume is increased. Therefore, compared to the burr (inner burr) 25*b* which occurs on the inner peripheral side, the loss of material is remarkably increased. Regarding the inner burr 25*b*, preferably this is not produced. However in the case where this is unavoidable, it is necessary to form this on a portion where it has minimal influence on the use of the finished product of the rocker arm 1.

(4) In the case of the rocker arm 1 for actual use, a circular hole for supporting the opposite ends of the support shaft with the roller supported on the middle portion, is formed in each of the side wall sections 2 (FIG. 22). However, in the case where these circular holes are simple cylindrical surfaces over their entire length, the opposite ends of the support shaft cannot be securely engaged with sufficient engagement strength in these circular holes. Therefore, it is difficult to sufficiently ensure the endurance of a cam follower constructed with the roller incorporated into the rocker arm 1. That is to say, in the case where the circular holes are simply cylindrical surfaces as described above, the opposite ends of the support shaft must be secured in these circular holes by a simple press fit, or by bonding or by a shrink fit or the like, so that it is difficult to sufficiently ensure the endurance of the cam follower. In the case of the method of manufacturing a rocker arm disclosed in Japanese Patent Application Publication No. H10-328778, there is no disclosure of forming the circular holes in the respective side wall sections 2, and of course improvement in the engagement strength of the opposite ends of the support shaft with respect to these circular holes is not considered.

(5) When cold forging is carried out at the second forging station 21 in order to form the first and second engagement sections 6 and 7 (FIG. 22) for abutting against the valve body or the rocking support member, no consideration is given to providing a run-off for the excess thickness portion of the material, close to the first and second engagement sections 6 and 7, at one part of the second intermediate blank 30. Therefore, in order to form the first and second engagement sections 6 and 7, the excess thickness portion of the second intermediate blank 30 effectively cannot be escaped, and the form accuracy and the dimensional accuracy of the first and second engagement sections 6 and 7 cannot be made good. Therefore, it is difficult to accurately engage the valve body or the lash adjuster at a predetermined position of the rocker arm 1.

From the above points, in the rocker arm and the manufacturing method therefor disclosed in Japanese Patent Application Publication No. H10-328778, there is room for improvement in the performance and endurance of an engine incorporating the obtained rocker arm.

Consequently, in the rocker arm and manufacturing method therefor of the present invention, in the case where the rocker arm is made by applying cold forging to a blank made of a metal wire rod, it is an object to improve the performance of an engine incorporating this rocker arm.

Furthermore, in the case of the method of manufacturing a rocker arm disclosed in Japanese Patent Application Publication No. H10-328778, the burrs 25, 25*a*, and 25*b* are formed in one part of the first intermediate blank 24 and the third intermediate blank 31. Therefore, the material cost is increased by the amount of these burrs 25, 25*a*, and 25*b*. In particular, in the case of the method of manufacturing a rocker arm disclosed in Japanese Patent Application Publication No. H10-328778, the volume of these burrs 25, 25*a*, and 25*b* is large. Next the reason for this is described. In the rocker arm 1 obtained by the method of manufacturing a rocker arm disclosed in Japanese Patent Application Publication No. H10-328778, the pair of side wall sections 2 are formed in an approximate rhomboid shape. Accompanying this, the first intermediate blank 24 which is manufactured in the second step at the first forging station 19, has an H-shape cross-section, and the widthwise dimension of the portion which is to become the side wall sections 2 (refer to FIG. 18) is formed so as to become smaller from near the lengthwise center towards the lengthwise opposite ends. On the other hand, the blank 13 which is to be subjected to cold forging in the second step, is a rectangular solid in which the area of the cross-section shape in relation to a direction perpendicular to the axial direction (the lengthwise direction) does not change along the entire axial length. That is to say, in the case of the method of manufacturing a rocker arm disclosed in Japanese Patent Application Publication No. H10-328778, in spite of the fact that the cross-section area of the first intermediate blank 24 which is to be obtained by the cold forging changes in relation to the lengthwise direction, the blank 13 which is to be subjected to cold forging is a rectangular solid in which the cross-section area thereof does not change along the entire axial length. When in this way the shape to be obtained by cold forging, and the shape of the blank 13 to be subjected to this cold forging are very different, the volume of the burrs 25, 25*a* and 25*b* to be removed in the later process becomes large.

A process accompanied by the positive outputting of the burr can be easily conceived by one skilled in the art, and comparatively easily executed. That is to say, the shape and dimension of the finished product largely depends on the shape and dimensions of the die for processing the blank or the intermediate blank which is to give the finished product. Consequently, if the volume of the blank or the intermediate blank is made slightly larger than the volume of the finished product to be obtained, the processing for obtaining the finished product can be easily performed, and the surplus portion produced at the time of each process can be produced as the burr, and cut-off in the later process.

However, if a lot of burr to be removed is produced in the cold forging then not only is a separate process for removing this burr necessary, but also this becomes a cause for an increase in material cost. Therefore, in the case of the method of manufacturing a rocker arm disclosed in Japanese Patent Application Publication No. H10-328778, there is still room for reducing the cost of the rocker arm.

Patent Document 1: Japanese Patent Application Publication No. H10-328778

DISCLOSURE OF THE INVENTION

Problems that the Invention is to Solve

Consequently, in the method of manufacturing a rocker arm of the present invention, the object of the invention is to obtain at low cost a rocker arm manufactured by cold forging by establishing processes so that either the burr is not produced, or if this is produced, the burr can be kept to a minimum.

Means to Solve the Problems

All of the rocker arms of the present invention and the rocker arms manufactured by the manufacturing method of the present invention, are made by applying cold forging to a blank which is obtained by cutting a metal wire rod to a predetermined length, and comprise: a pair of side wall sections provided with a space therebetween; a first connecting section and a second connecting section which connect corresponding portions near lengthwise opposite ends of these two side wall sections; and a pair of through holes formed in these two side wall sections at mutually matching positions. The first connecting section has a first engagement section which engages with a valve body, the second connecting section has a second engagement section which engages with a rocking support member, and a roller is supported on an middle portion of a support shaft with opposite ends supported in the through holes.

In the rocker arm of the present invention, according to a first aspect, the whole of a sheared face (fractured face) formed on the inside face of the side wall sections by punch processing for forming the first and second connecting sections, does not face the opposite end faces of the roller. There is also a case where a chamfer is formed on the connecting portion of the opposite end faces and the outer peripheral face of the roller. Here "opposite end faces of the roller" are the portions excluding this chamfer (towards the center from the inner peripheral edge of the chamfer).

In the rocker arm of the present invention, according to a second aspect, the lengthwise opposite end rims of the side wall sections which are positioned on one side of the first and second connecting sections which becomes the opposite side to the first engagement section, are arranged in relation to the lengthwise direction between from a portion of the first engagement section which is to abut against the center of the base end face of the valve body, up to a portion of the second engagement section which is to abut against the center of the tip end face of the rocking support member, or to the center of a screw hole for threading with a male thread portion provided on the rocking support member.

A manufacturing method for manufacturing a rocker arm according to the first aspect, comprises a punching process for forming the first and second connecting sections by applying punch processing to a base of an intermediate blank which is provided with the pair of side wall sections and a base which connects pairs of portions of these two side wall sections, and the shape and dimensions of the intermediate blank are controlled so that in the case where it is assumed that a roller is arranged at a position corresponding to an arrangement position of the roller of the rocker arm to be obtained, on the inside of the intermediate blank which is to be subjected to punch processing, the roller and the base do not interfere.

According to the rocker arm of the present invention and the rocker arm obtained by the manufacturing method therefor of the present invention respectively constructed as described above, with the rocker arm obtained by applying cold forging to a blank made from a metal wire rod; a performance improvement of an engine fitted with this rocker arm is obtained.

That is to say, with the rocker arm according to the first aspect, contacting of the sheared face and the fractured face formed by the punching process, on the inside face of the side wall sections, with the opposite end faces of the roller can be prevented. Therefore, with a rocker arm fitted with this roller, the roller can rotate smoothly. Furthermore, the occurrence of abnormal wear on the opposite end faces of the roller can be prevented, and the occurrence of abrasion powder due to wear at the contact portions can be suppressed. Consequently, an improvement in performance, such as the output performance of an engine fitted with the rocker arm is possible. Furthermore, in the process after the punching process, it is not necessary to perform the troublesome operation of smoothening the sheared face (fractured face) by face pressing or the like.

Moreover, in the case of the rocker arm according to the second aspect, since the volume of the side wall section can be kept small, overall lightening of the rocker arm is achieved. Therefore, performance improvement of an engine fitted with this rocker arm is possible.

All of the rocker arms according to the following aspects of the present invention are made by applying cold forging to a blank which is obtained by cutting a metal wire rod into a predetermined length, and comprise: a pair of side wall sections which are provided with a space therebetween; a first and second connecting section which connect the portions near the lengthwise opposite ends of the two side wall sections; and a pair of through holes concentric with each other and formed at mutually matching positions of these two side wall sections, and these first and second connecting sections have engagement sections which engage with a valve body or a rocking support member.

A rocker arm according to a third aspect, is made by a process comprising: a step for making an intermediate blank by applying cold forging to the blank by pressing the blank from lengthwise opposite sides; and a step for making a second intermediate blank by applying cold forging to the first intermediate blank by pressing the first intermediate blank from opposite sides in a direction perpendicular to the lengthwise direction.

In a rocker arm according to a fourth aspect, when forming the through holes in the side wall sections, chamfers are simultaneously formed on the outside open end portions of the through holes.

In a rocker arm according to a fifth aspect, when the first engagement section or the second engagement section are formed by applying cold forging to the blank or to the intermediate blank obtained from the blank, to thereby make an intermediate blank or an other intermediate blank, at one part of the intermediate blank or the other intermediate blank, of the portions which are away toward the inside in the widthwise direction from the pair of side wall sections, at least one portion at the same position in relation to the lengthwise direction, as the portion which is to form the first engagement section or the section engagement section, is made a run-off portion which is not struck by a die used in the cold forging.

In a rocker arm according to a sixth aspect, a fiber flow which is the flow of the internal fibrous structure, flows in the lengthwise direction of the overall rocker arm, and this fiber flow is not cut at least at the portions excluding the lengthwise opposite ends, and the inner peripheral face of the circular hole formed between the first and second connecting sections.

Furthermore, in a manufacturing method for manufacturing a rocker arm according to the third aspect, there is provided: a step for making a first intermediate blank by applying cold forging to a blank by pressing the blank from lengthwise opposite sides; and a step for making a second intermediate blank by applying cold forging to the first intermediate blank by pressing the first intermediate blank from opposite sides in a direction perpendicular to the lengthwise direction.

Moreover, in the manufacturing method for manufacturing a rocker arm according to the third aspect, there is provided: a step for making a first intermediate blank in which the cross-section area is changed in the lengthwise direction corresponding to the change in the cross-section area in the direction perpendicular to this lengthwise direction, in relation to the lengthwise direction of the rocker arm to be obtained, by applying cold forging to a blank by pressing the blank from lengthwise opposite sides; and a step for applying cold forging to the first intermediate blank by pressing the first intermediate blank from opposite sides in a direction perpendicular to the lengthwise direction, so as not to generate a burr on the outer peripheral side.

Furthermore, in a manufacturing method for manufacturing a rocker arm according to the fourth aspect, when forming the through holes in the side wall sections, chamfers are simultaneously formed on the outside open end portions of the circular holes.

In a manufacturing method for manufacturing a rocker arm according to the fifth aspect, when the first engagement section or the second engagement section are formed by applying cold forging to the blank or to the intermediate blank obtained from the blank, to thereby make an intermediate blank or an other intermediate blank, at one part of the intermediate blank or the other intermediate blank, of the portions which are away toward the inside in the widthwise direction from the pair of side wall sections, at least one portion at the same position in relation to the lengthwise direction, as the portion which is to form the first engagement section or the section engagement section, is made a run-off portion which is not struck by the die used in the cold forging.

According to the rocker arm constructed as described above and the manufacturing method therefor, when the rocker arm is made by applying cold forging to a blank made of a metal wire rod, performance improvement of an engine incorporating this rocker arm is achieved.

That is to say, in the case of the rocker arm according to the third aspect, the pressing directions when cold forging the blank and the first intermediate blank are 90 degrees different. Therefore, compared to the case where in all of the cold forging steps, the blank and the intermediate blank are pressed from opposite sides in the same direction, the concentration of excessive stress at one portion of the obtained rocker arm can be suppressed. Furthermore, in the case where a metal wire rod is made by extrusion forming, the flow (fiber flow) of the internal fibrous structure of the blank can be made to substantially coincide with the lengthwise direction of the blank. Furthermore, most of the fiber flow of the first intermediate blank obtained from this blank can be made approximately parallel to or close to parallel to the lengthwise direction of the first intermediate blank. In the case of the rocker arm according to the third aspect, the first intermediate blank is subjected to cold forging by pressing the first intermediate blank in a direction perpendicular to the lengthwise direction. Therefore compared to the case where cold forging is applied to the first intermediate blank by pressing the first intermediate blank from opposite sides in the lengthwise direction, the fiber flow of the obtained rocker arm can be made a smooth flow corresponding to the overall shape of the rocker arm. As a result, the strength of the obtained rocker arm can be improved, and an improvement in endurance of an engine fitted with this rocker arm is achieved.

In the case of the manufacturing method for manufacturing a rocker arm according to the third aspect, since when the cold forging is applied to the first intermediate blank, this is done so as not to generate a burr (outer burr) on the outer peripheral side, then different to the case of the method of manufacturing a rocker arm disclosed in Japanese Patent Application Publication No. H10-328778, there is no creation of fiber flow in the outer burr portion. Therefore, there is no disturbance of the fiber flow at the outer burr portion, and there is also no cutting of the fiber flow accompanying the removal of the outer burr. Hence, the strength of the finished product (manufactured product) of the rocker arm is improved. Furthermore, there is also no occurrence of defects attributable to the sheared face or the fractured face accompanying removal of the outer burr, so that the form accuracy of the rocker arm can be made good. Moreover, the forging load can be reduced, and a reduction in material cost is easily achieved.

While it is preferable that there is no burr (inner burr) produced on the inner peripheral side, even in the case where an inner burr is formed, preferably this inner burr is formed at a position where it does not exert an influence on the use of the rocker arm.

In the case of the rocker arm according to the-fourth aspect, the opposite end portions of the support shaft which supports the roller can be crimped and fixed (in a condition where the portion plastically deformed radially outward and the chamfer portion are engaged) to the peripheral rims of the outside open peripheral edges of the through holes which are formed in the side wall sections. Therefore, in a cam follower which is made by fitting a roller to the rocker arm, the opposite end portions of the support shaft can be connected and secured with sufficient connection strength to the side wall sections, giving an improvement in the endurance of an engine provided with this rocker arm. Furthermore, the operation of inserting the end of the support shaft into the through holes can be easily performed. Therefore, this gives a cost reduction for the rocker arm combined with the support shaft.

In the case of the rocker arm according to the fifth aspect, when the first engagement section and the second engagement section are formed by cold forging to thereby make an intermediate blank or an other intermediate blank, of the blank or the intermediate blank, the excess thickness portion existing at a position close to the portion which is to form the first engagement section or the second engagement section, can be smoothly allowed to escape. Therefore, the form accuracy and the dimension accuracy of the first engagement section and the second engagement section can be made good, so that at the time of use of the obtained rocker arm, the valve body or the rocking support member can be accurately engaged with the predetermined portion of the rocker arm. Consequently, performance improvement of an engine provided with the rocker arm is achieved. Moreover, it is possible to prevent an excessive load being applied to the dies used in the cold forging, and the endurance of the dies can thus be increased. Therefore, the unit cost when mass manufacturing the rocker arm can be decreased.

In the case of a rocker arm according to the sixth aspect, the forming workability can be made good, and an improvement in the strength and the form accuracy achieved.

In the case of a manufacturing method for a rocker arm according to the following aspects, there is manufactured a rocker arm made by applying cold forging to a blank which is obtained by cutting a metal wire rod having a circular cross-section into a predetermined length, the rocker arm comprising: a pair of side wall sections provided with a space therebetween; and a pair of connecting sections which connect corresponding portions near the lengthwise opposite ends of these two side wall sections, and these connecting sections having engagement sections which engage with a valve body and a rocking support member.

In order to manufacture this rocker arm, then in the method of manufacturing a rocker arm according to this aspect, there are provided: a step for applying a first cold forging to the blank, to thereby make an intermediate blank with a cross-section area changed in relation to the axial direction, corresponding to a change in the cross-section area related to the lengthwise direction of the rocker arm to be obtained: a step for applying at least a second cold forging to the first intermediate blank, to thereby make a second intermediate blank provided with the side wall sections and a base which connects the side wall sections in part; and a hole forming step for applying a hole forming process for forming a hole in the lengthwise middle portion of the base of the second intermediate blank, to thereby make a third intermediate blank provided with a pair of connecting sections.

In the method of manufacturing a rocker arm according to this aspect, preferably the first intermediate blank made by applying the first cold forging to the blank is a barrel shape with the diameter maximum at an axial middle portion.

In the method of manufacturing a rocker arm according to this aspect, in the case where; a cross-section area of the first intermediate blank at a maximum diameter portion where the diameter thereof becomes a maximum, related to a virtual plane perpendicular to the axial direction, is $S_1$; the total of cross-section areas of the pair of side wall sections which constitute the rocker arm to be obtained, at a position corresponding to the maximum diameter portion of the first intermediate blank in relation to the lengthwise direction, related to the virtual plane perpendicular to the lengthwise direction, is $S_2$; and a cross-section area of a small piece which is produced in a hole forming process by punching the base in a punching process being the hole forming process, at a position corresponding to the maximum diameter portion of the first intermediate blank in relation to the lengthwise direction, related to the virtual plane perpendicular to the lengthwise direction, is $S_3$, then the shape and dimension of the first intermediate blank is preferably controlled so as to satisfy the relationship $S_1 \geqq S_2+S_3$.

Furthermore, in the method of manufacturing a rocker arm according to this aspect, the diameter of the maximum diameter portion of the first intermediate blank is preferably approximately the same as a distance between the outside faces of the pair of side wall sections which constitute the rocker arm to be obtained, at a position corresponding to the maximum diameter portion in relation to the lengthwise direction.

In the method of manufacturing a rocker arm according to this aspect, preferably the overall length in the axial direction of the first intermediate blank and the overall length of the rocker arm to be obtained are approximately the same size.

Effects of the Invention

In the case of the method of manufacturing a rocker arm of the present invention constructed as described above, by setting the shape of the blank and the intermediate blank, and the steps subsequent to the first forging steps appropriately, corresponding to the shape of the rocker arm product to be obtained, there is no longer the occurrence of a burr to be removed, and even if this occurs, this burr can be kept to a minimum.

For example, in the case where the first intermediate blank made by applying the first cold forging to the blank, is a barrel shape with the diameter becoming a maximum at the axial middle portion, then in the case where the shape of the first intermediate blank is set, when making a rocker arm with a shape where the side wall sections are of a shape such as an approximate rhombic shape or an approximate triangular shape where the widthwise dimension becomes smaller from near the lengthwise center towards the lengthwise opposite ends, there is no longer the occurrence of a burr to be removed, and even if this occurs this burr can be kept to a minimum. In the case where the rocker arm is the shape as described above where the widthwise dimension becomes smaller from near the lengthwise center towards the opposite lengthwise ends, lightening of the rocker arm can be achieved. Furthermore, in the second cold forging, the plastic deformation of the first intermediate blank can be made small, and hence it is possible to prevent an excessive load being applied to the dies used in the cold forging, so that the endurance of the dies can be improved. Therefore, unit cost at the time of mass production of the rocker arm can be reduced. Furthermore, since the first intermediate blank can be formed in a barrel shape by compressing in the axial direction, then for the metal wire rod for obtaining the rocker arm, one with a small diameter can be used. As a result, a light weight rocker arm can be made at low cost. Since the first intermediate blank is symmetrical about the central axis, then at the time of forging, it is not necessary to restrict the phase of the rotation direction in relation to the central axis of the first intermediate blank. Moreover, if a horizontal multistage cold forging machine being a known manufacturing machine is used, then automation of the manufacturing is facilitated, so that workability is good, and manufacturing time can be shortened. Therefore manufacturing costs can be greatly reduced. In the case where it is possible to prevent the occurrence of a burr, material costs can be further reduced, and a mechanism for removing and discharging the burr becomes unnecessary, so that structure of the dies for the cold forging machine can be simplified.

Furthermore, dimensional accuracy and profile accuracy of the obtained rocker arm can be improved.

Moreover, in the case of the manufacturing method as described above where the shape and dimensions of the first intermediate blank are controlled so as to satisfy the relationship $S_1 \geqq S_2+S_3$, then when performing the second cold forging, each portion of the first intermediate blank can be plastically deformed while extruding the material from near the maximum diameter portion of the first intermediate blank towards other portions, so that formability can be made good.

Moreover, if the construction is such that the diameter at the maximum diameter portion of the first intermediate blank is approximately the same as the distance between the outside faces of the pair of side wall sections which constitute the rocker arm to be obtained, at a position corresponding to the maximum diameter portion in relation to the lengthwise direction, then the amount of plastic deformation of the first intermediate blank in the second cold forging can be made small. Therefore an excessive load being applied to the dies used for cold forging can be more effectively prevented, and the endurance of the dies can be further improved. Hence the unit cost at the time of mass production of the rocker arm can be further reduced. Moreover, since the position of the first intermediate blank 33 at the time of the second cold forging can be controlled in the thickness direction of the opposite side wall sections, the form accuracy can be made good.

Furthermore, if the construction is such that the overall length in the axial direction of the first intermediate blank, and the overall length of the rocker arm to be obtained are approximately the same size, then in the second cold forging, the positioning in the axial direction of the first intermediate blank can be easily performed. Therefore addition of an excessive load or an unbalanced load on the dies used for the cold forging can be more effectively prevented, so that the endurance of the dies can be improved. Furthermore, the form accuracy of the rocker arm can be made good.

BEST MODE FOR CARRYING OUT THE INVENTION

Figure 1:
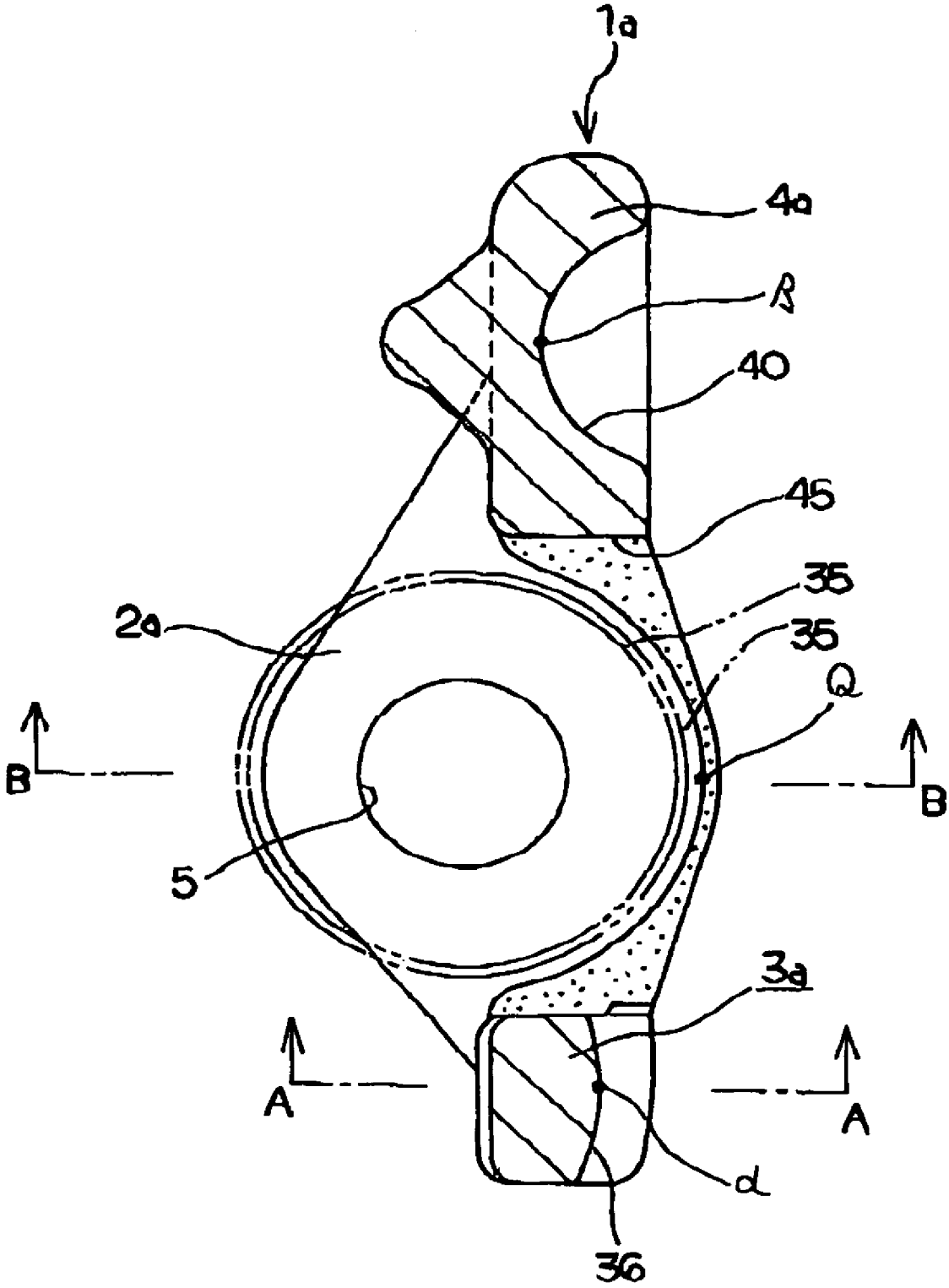
FIG. 1 is a cross-section showing a finished product of a rocker arm of a first example of an embodiment of the present invention, with one part omitted.

FIG. 1 through FIG. 21 show a first example of an embodiment of the present invention.

A characteristic of this example is that in order to improve the performance of an engine provided with a rocker arm 1*a* where the rocker arm 1*a* is obtained by applying cold forging to a blank made from a metal wire rod, the positional relationship between the sheared face and the fractured face produced by punching one part of the second intermediate blank 34*b* (FIG. 11 to FIG. 15) and the roller 35, and the position of the lengthwise opposite ends of the pair of side wall sections 2 are each controlled.

Furthermore, a characteristic of this example is that when making the rocker arm 1*a* (FIG. 1 to FIG. 4) by applying cold forging to the blank 32 (FIG. 6) made of metal wire rod, in order to improve the performance of an engine provided with the obtained rocker arm 1*a*, a plan is respectively devised; for the pressing direction when applying cold forging to the blank 32 and the first intermediate blank 33 (FIG. 7) obtained from this blank 32, for the punching operation when forming a through hole 5 in the respective side wall sections 2*a*, and for the cold forging operation when forming first and second concavities 36 and 40, being respective first and second engagement sections.

In the manufacturing equipment for the rocker arm 1*a*, since this is substantially the same as the aforementioned manufacturing equipment shown in FIG. 22 to FIG. 28, repeated description is omitted or simplified, and hereunder the description is centered on the characteristic parts of the example.

The rocker arm 1*a* of this example, as shown in FIG. 1 to FIG. 4, has a pair of side wall sections 2*a* each formed in an approximate triangular shape and substantially parallel with each other, and a first connecting section 3*a* and a second connecting section 4*a* which connect lengthwise (up and down direction in FIG. 1 and FIG. 2) opposite end portion of the pair of two side wall sections 2*a*. In the lengthwise middle portion of the two side wall sections 2*a* is formed a pair of circular holes 5 concentric with each other, the construction being such that opposite end portions of a support shaft (not shown in the figure) for rotatably supporting a roller 35 for engaging with a cam, at a middle portion thereof, are fixedly supported in these two circular holes 5.

In order to abut against the base end of a valve body, the first concavity 36 which is the first engagement section, is formed on one side (the right face in FIG. 1 and FIG. 3; the front face in FIG. 2) of the first connecting section 3*a*. Furthermore, in order to abut against the tip end of a lash adjuster, the second concavity 40 with a hemisphere face, which is the second engagement section, is formed on one side (the right face in FIG. 1; the front face in FIG. 2) of the second connecting section 4*a*.

In the case of this example, an example is shown where the tip end of the lash adjuster is engaged in the second engagement section as a rocking support member. However the present invention is also applicable in relation to a construction where a threaded hole is formed in the second connecting section 4*a*, and an adjuster screw is screwed into this threaded hole portion.

In the case of this example, the lengthwise (up and down direction in FIG. 1 and FIG. 2) opposite ends of the side wall sections 2*a* positioned on the other face (the left face in FIG. 1 and FIG. 3; the back face in FIG. 2) of the first and second connection sections 3*a* and 4*a*, are arranged in relation to the lengthwise direction, between from a portion $\alpha$ of the first concavity 36 which is to abut against the center of the tip end face of the valve body, up to a portion $\beta$ of the second concavity 40 which is to abut against the center of the tip end face of the lash adjuster. Furthermore, as shown in FIG. 2, in a condition where the rocker arm 1*a* is seen in the widthwise direction of the side wall sections 2*a*, the shape of the outer peripheral rim of the rocker arm 1*a* is a shape similar to where a pair of trapezoids are connected to lengthwise opposite ends of a rectangle, and pairs of mutually adjacent straight line portions 56*a* to 56*g* are smoothly connected by curved line sections 57*a* to 57*h*. Furthermore, the shape of the first and second connecting sections 3*a* and 4*a* when seen in the thickness direction (the same direction in FIG. 2) is a trapezoid shape with corners rounded, comprising the plurality of straight line sections 56*a*, 56*c* to 56*e*, 56*g* and 56*h*.

Figure 4:
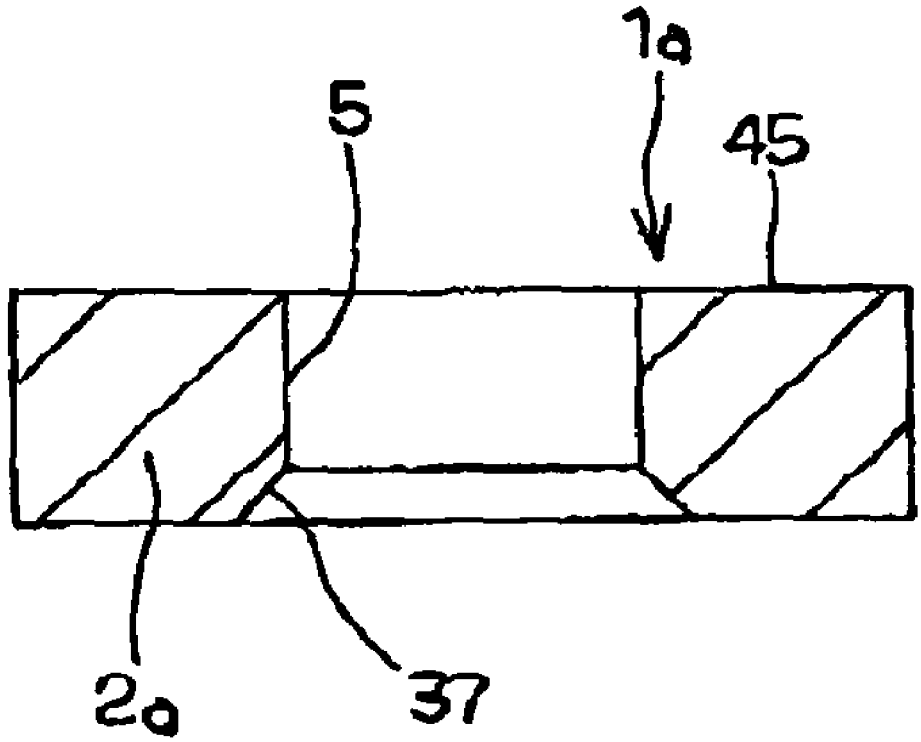
FIG. 4 is a cross-section on B—B of FIG. 1.
Figure 5:
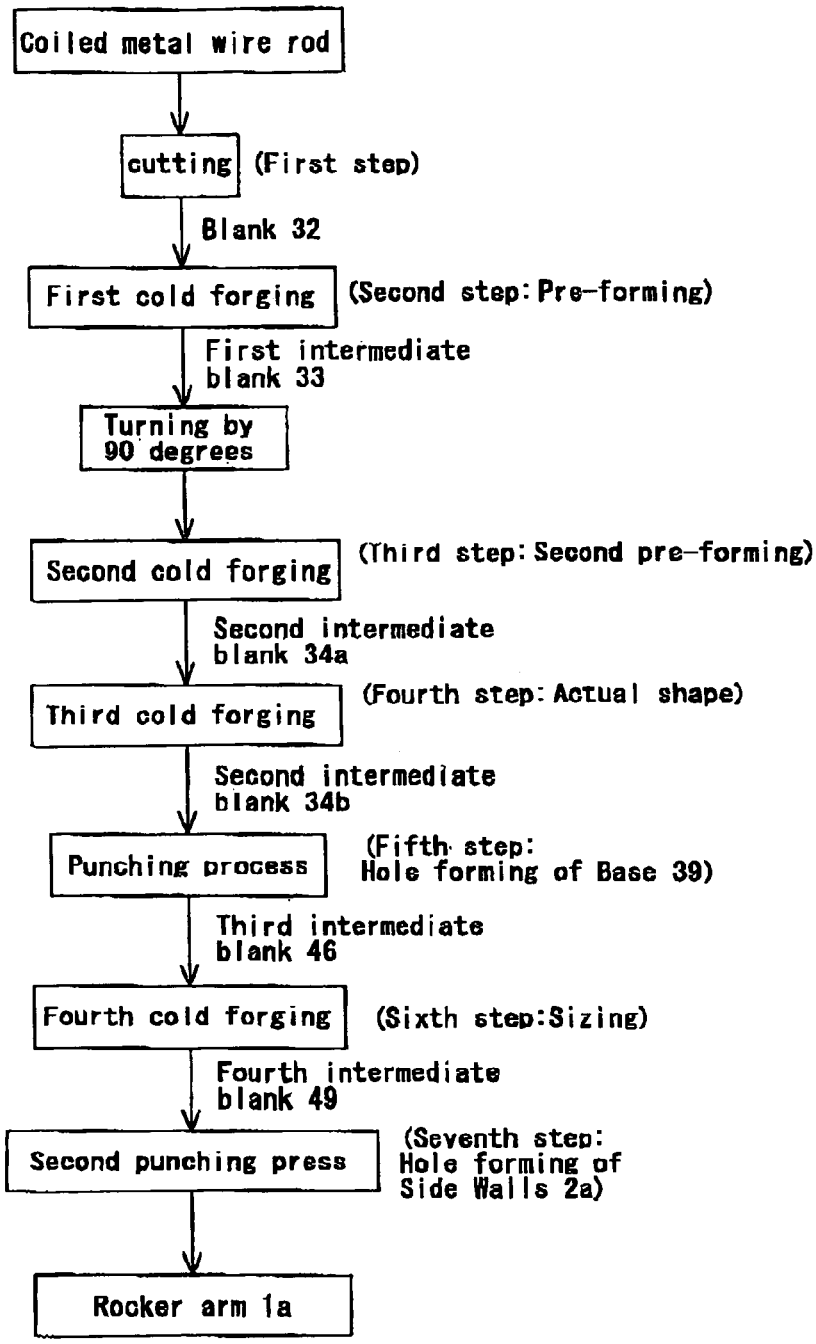
FIG. 5 is a flow chart showing a method of manufacturing a rocker arm.

As shown in FIG. 4, a chamfer 37 of a mortar shape with the generatrix being a straight line, is formed on the open end peripheral rim portion of the axial outer side (bottom side in FIG. 4) of the circular hole 5 for supporting the opposite ends of the support shaft. This chamfer 37 is used to facilitate the operation of inserting the end portion of the support shaft into one of the circular holes 5 of the respective circular holes 5, and for crimp securing the opposite end outer peripheral rims of the support shaft in the open end peripheral rim portions of the circular holes 5.

Figure 2:
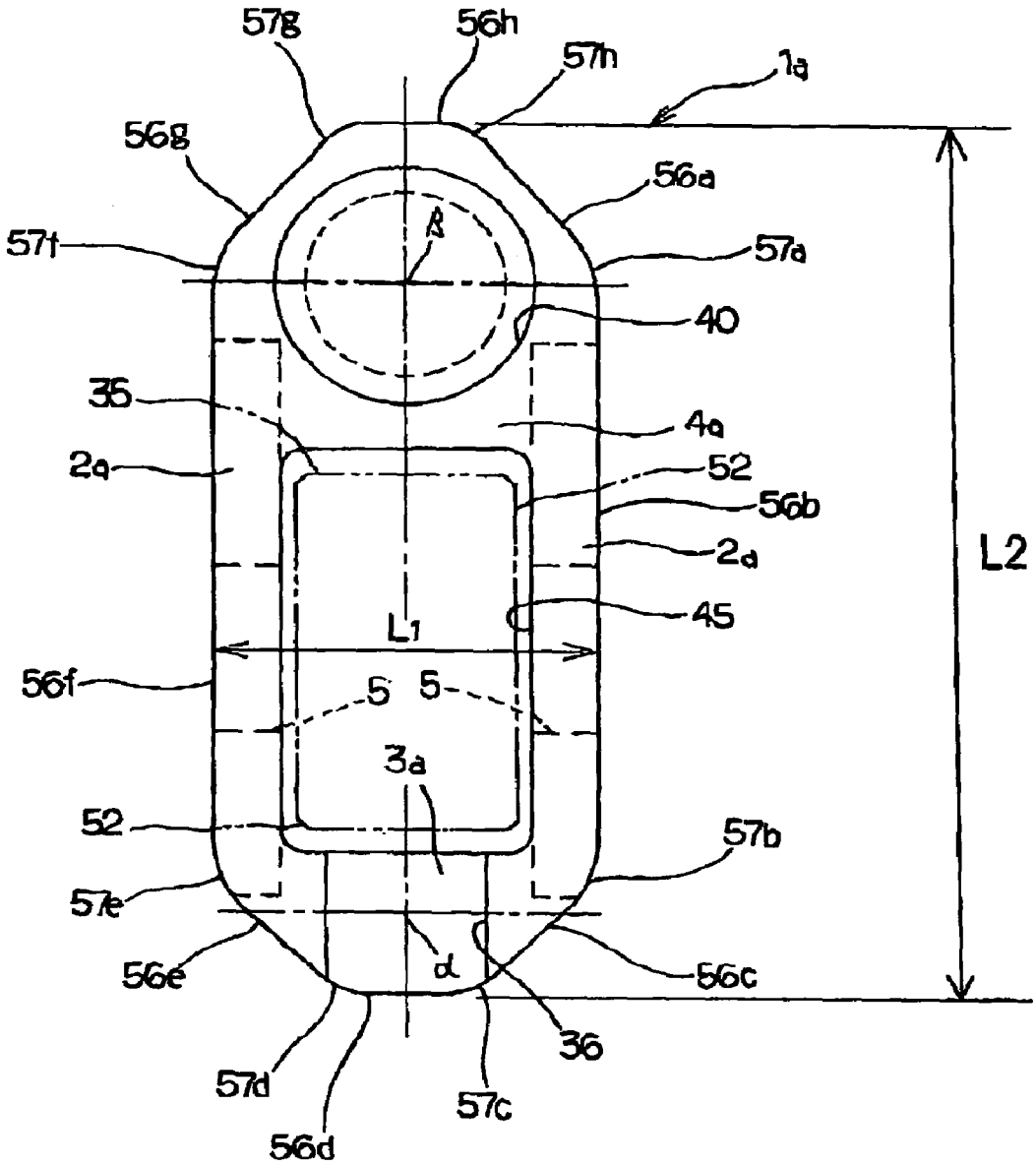
FIG. 2 is a view from the right in FIG. 1.
Figure 3:
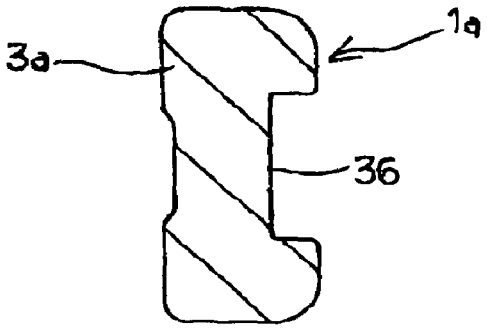
FIG. 3 is a cross-section on A—A of FIG. 1.

In the case of the rocker arm 1*a* of this example, due to the punching operation for forming the first and second connecting sections 3*a* and 4*a*, a sheared face (fractured face) as shown by the speckled region in FIG. 1, is formed on the inside face of a portion towards one widthwise edge (the portion towards the right edge in FIG. 1 and FIG. 4) of the respective side wall sections 2*a*. Furthermore, the whole of this sheared face (fractured face) does not face the opposite end faces of the roller 35 nor the chamfer 52 (FIG. 2) formed on the connecting section between these opposite end faces and the outer peripheral face. However, since the chamfer 52 portion does not rub against the inside face of the respective side wall sections 2*a*, it does not pose a hindrance to having the chamfer 52 and the sheared face (fractured face) oppose each other.

Figure 13:
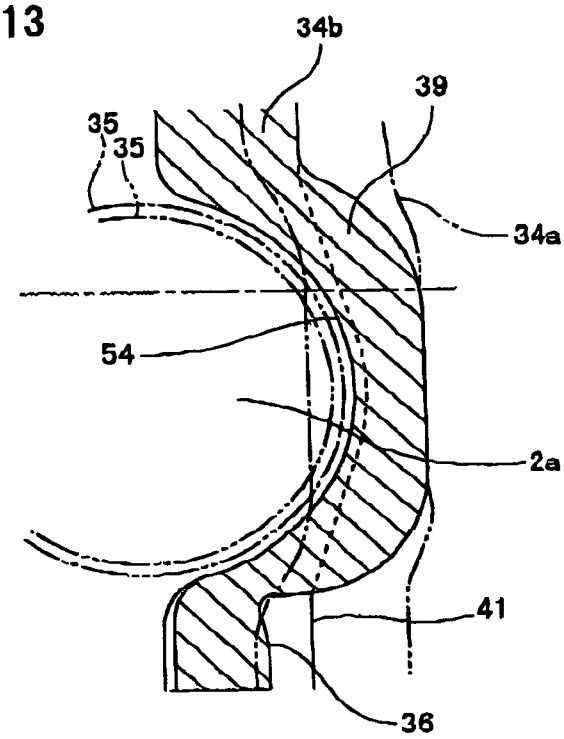
FIG. 13 is an enlarged view of a part of FIG. 11(*a*).
Figure 14:
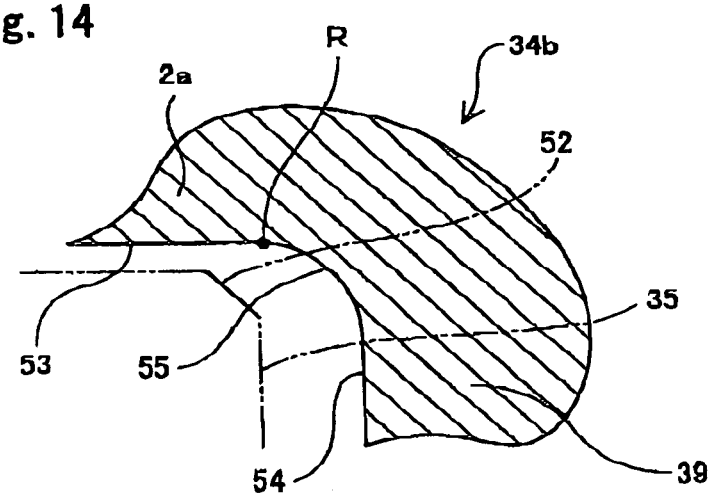
FIG. 14 is a cross-section of an enlarged portion F of FIG. 12.

In FIG. 1, the roller 35 is shown as two concentric two-dot chain lines, however the outside circle of these concentric circles represents the outer peripheral surface of the roller 35 (outer peripheral edge of the chamfer 52), while the inside circle represents the end face of the roller 35 (the inner peripheral edge of the chamfer 52) (the same applies to FIG. 13 and FIG. 18 mentioned later).

In the case of this example, of the sheared face (fractured face), a portion (point Q) towards the most widthwise one side (the right side in FIG. 1) at the rim edge on the roller 35 side (the left side in FIG. 1), is arranged to the widthwise one side (the right side in FIG. 1) of a portion away from the first and second respective concavities 36 and 40 of the one side (right side) of the first and second respective connecting sections 3*a* and 4*a*.

The respective side wall sections 2*a* are formed in approximate triangular shapes. The reason for forming these side wall sections 2*a* in such shapes is in order to achieve compatibility between forming the circular holes 5 of a predetermined size in the middle portion of the side wall sections 2*a*, and lightening of the rocker arm 1*a*. Furthermore, in a case such as where in one part of the side wall sections 2*a*, the circular holes 5 are formed at approximately the same positions in the widthwise direction (the left and right direction in FIG. 1, the front and back direction in FIG. 2) as the first and second connecting sections 3*a* and 4*a*, then the side wall sections 2*a* may be formed in an approximate rhombic shape in consideration of lightening. In this case also, by adopting the manufacturing method of the present invention, if the processes and the shape of the intermediate blank are set appropriately, it is possible to manufacture a rocker arm having a desired shape.

The rocker arm 1*a* of this example constructed as described above is manufactured as shown in FIG. 5. Next is a detailed description of the manufacturing method for the rocker arm 1*a*. At first, the end of a metal wire rod which is wound in a coil on the rotating support apparatus 8, is inserted into the inside of the cold forge forming machine 10 by a roller type wire feed mechanism 11 (refer to FIG. 23)

or the like, provided in the cold forge forming machine 10. In the case of this example, the cross-section of the metal wire rod is circular. Moreover, the metal wire rod is formed with a lubricating film layer of zinc phosphate film or the like on the outer peripheral surface, by previously pickling in a lubrication liquid tank of a zinc phosphate or the like.

This metal wire rod is made by extrusion forming. Therefore, the direction of the fiber flow of the internal structure of the metal wire rod substantially matches with the lengthwise direction of the metal wire rod.

In the case of this example, the fiber flow which is the flow of the fibrous structure of the rocker arm 1*a*, flows in the lengthwise direction of the rocker arm 1*a* overall. Furthermore, this fiber flow is not cut at least at the portions excluding at the lengthwise opposite ends, and the inner peripheral face of the hole 45 formed between the first and second connecting sections 3*a* and 4*a*.

Figure 6:
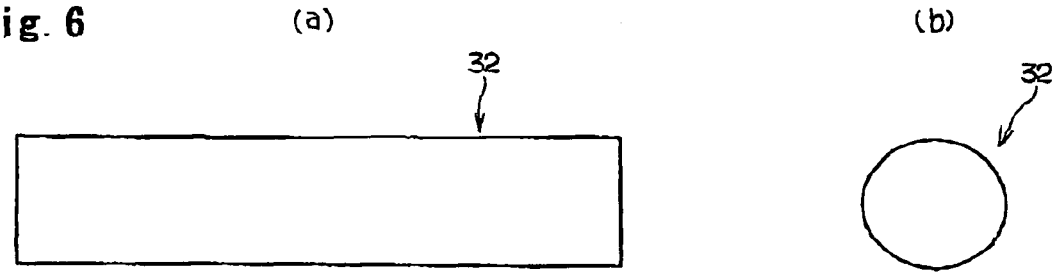
FIG. 6 shows a blank obtained by a first step of the method of manufacturing a rocker arm, wherein (a) is a front view, and (b) is a view from the side of (a).

As a first step, the blank 32 of a columnar shape as shown in FIG. 6 is made by cutting the metal wire rod to a predetermined length in a cutting mechanism 12 (refer to FIG. 24) provided in the cold forge forming machine 10. The cold forge forming machine 10 used for making the rocker arm in this example is substantially the same as the one shown before in FIG. 23 to FIG. 28 used in the conventionally known rocker arm manufacturing method. Therefore, in the following description, the specific structure of the cold forge forming machine 10 is omitted or simplified. The cold forge forming machine 10 used in this example differs from the one shown before in FIG. 23 to FIG. 28, in that a burr (outer burr) is not produced on at least the outer peripheral side in the manufacturing step for the rocker arm 1*a*.

Figure 7:
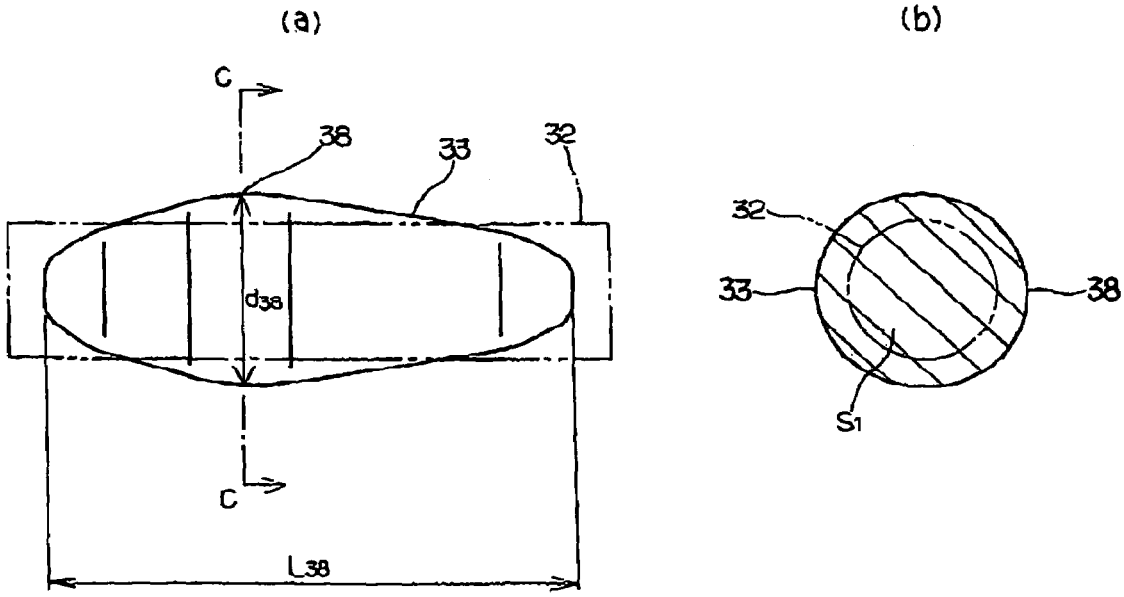
FIG. 7 shows a first intermediate blank obtained by a second step, wherein (a) is a front view, and (b) is a cross-section on C—C of (a).

The columnar blank 32 obtained in the first step is moved to the first forging station provided in the cold forge forming machine 10 without changing direction. Then, as a second step, the blank 32 is punched in the horizontal direction in the fixed die by means of the movable die, to thereby apply a first cold forging (pre-forming) to swell the blank 32 in the radial direction while compressing in the axial direction (lengthwise direction), and make a first intermediate blank 33 having the shape as shown in FIG. 7. That is to say, in the first cold forging, the blank 32 is pressed by the movable die and the fixed die from opposite axial sides of the blank 32.

The first intermediate blank 33 obtained in this manner has a shape of a barrel where the diameter is a maximum at the axial middle portion. That is to say, in the first intermediate blank 33, the diameter reduces from the maximum diameter portion 38 provided at the middle portion, where the diameter is a maximum, towards the axial opposite ends.

The axial opposite end faces of the first intermediate blank 33 are substantially flat.

The axial position of the maximum diameter portion 38 is controlled to match with the position of the pair of side wall sections 2*a*, and is an axial middle portion but is not necessarily the axial central portion.

The respective cross-section areas in the direction perpendicular to the axial direction of the barrel shape first intermediate blank 33, substantially correspond with the respective cross-section areas in the direction perpendicular to the lengthwise direction of a second intermediate blank 34*b* later mentioned. The shape of the first intermediate blank 33 must be carefully set in consideration of the flow of material or the like at the time of forging.

Figure 8:
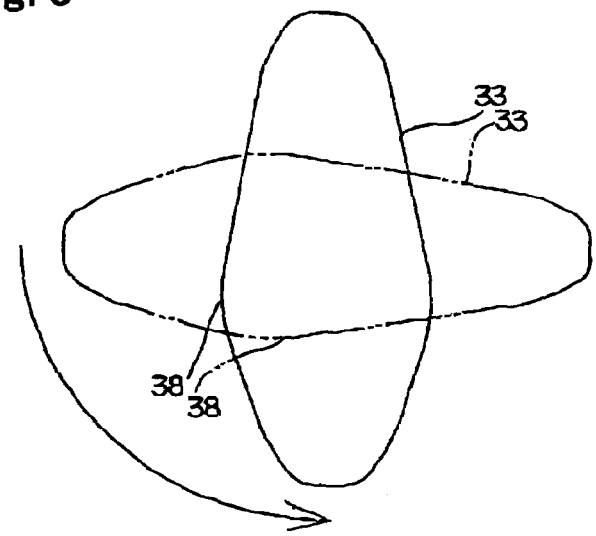
FIG. 8 is a diagram showing a condition where, when a first intermediate blank is moved from a first forging station to a second forging station, the direction of the first intermediate blank is changed by 90 degrees.

Once the first intermediate blank 33 has been formed, then by means of a blank rotation feeder 23 (refer to FIG. 24) provided in the cold forge forming machine 10, the first intermediate blank 33 is fed from the first forging station to a second forging station while the direction of the first intermediate blank 33 is turned by 90 degrees as shown in FIG. 8.

Figure 9:
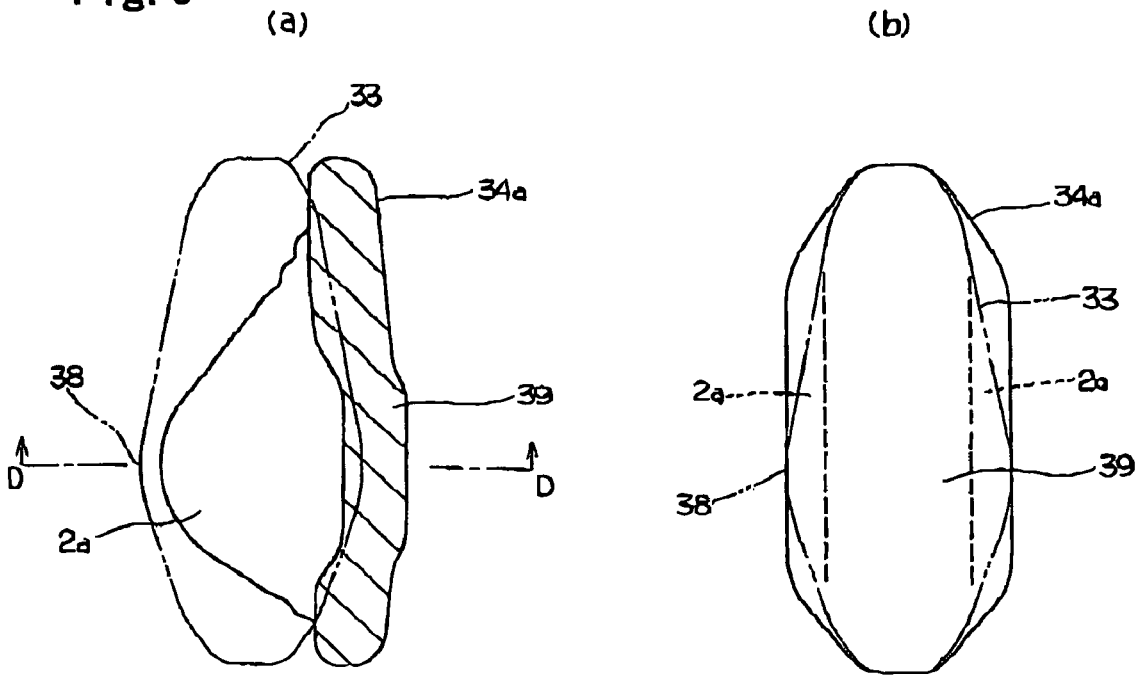
FIG. 9 shows a second intermediate blank obtained by a third step, wherein (a) is a cross-section, and (b) is a view seen from the right of (a).
Figure 10:
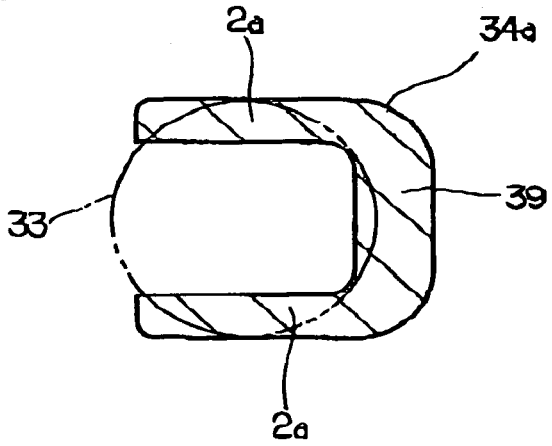
FIG. 10 is a cross-section on D—D of FIG. 9(*a*).

Then as a third step, the first intermediate blank 33 is punched in a horizontal direction in the fixed die by the movable die of the second forging station, to thereby apply a second cold forging (second pre-forming) which compresses the first intermediate blank 33 from the radially opposite sides thereof. Then, as shown in FIG. 9 and FIG. 10, the second intermediate blank 34*a* having roughly the shape and dimensions of the rocker arm 1*a* (FIG. 1 to FIG. 4) is made. This second intermediate blank 34*a* comprises the pair of side wall sections 2*a*, and a base 39 which connects the widthwise each one edges (right edges in FIG. 9(*a*) and FIG. 10) of these two side wall sections 2*a*. Furthermore, the lengthwise middle portion of the base 39 protrudes slightly to the opposite side (the right side in FIG. 9(*a*) and FIG. 10) to the side wall sections 2*a*. Moreover, in the case of this example, at a position corresponding to the maximum diameter portion 38 of the first intermediate blank 33, the dimension in the widthwise direction (the left right direction in FIG. 9(*a*) and FIG. 10) of the side wall sections 2*a* which constitute the second intermediate blank 34*a* is made a maximum. Since a lubricating film layer is formed beforehand on the outer peripheral face of the first intermediate blank 33 which is subjected to this cold forging, the friction acting between the inside of the fixed die and the movable die, and the outside of the first intermediate blank 33 can be kept to a minimum. Furthermore, by means of this construction, the forming workability and the form accuracy of the second intermediate blank 34*a* can be made good. The second intermediate blank 34*a* obtained by this third step is taken out from between the fixed die and the movable die, and is supplied to a third forging station.

Figure 11:
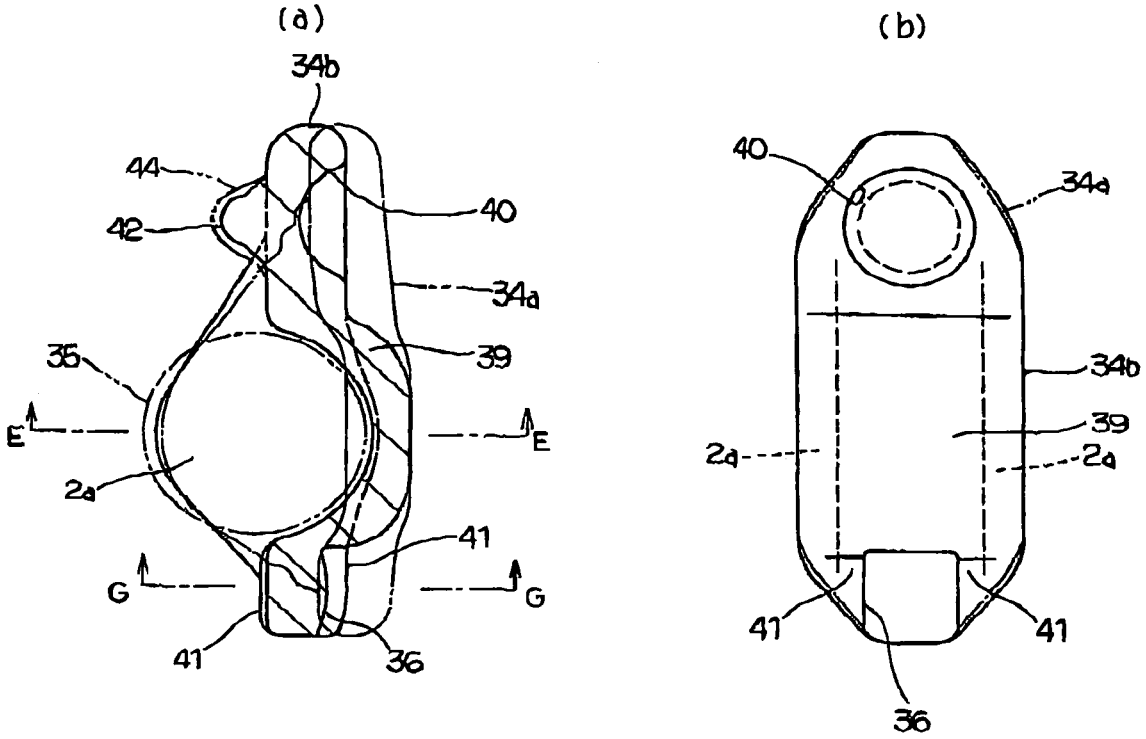
FIG. 11 shows a second intermediate blank obtained by a fourth step, wherein (a) is a cross-section, and (b) is a view seen from the right of (a).
Figure 12:
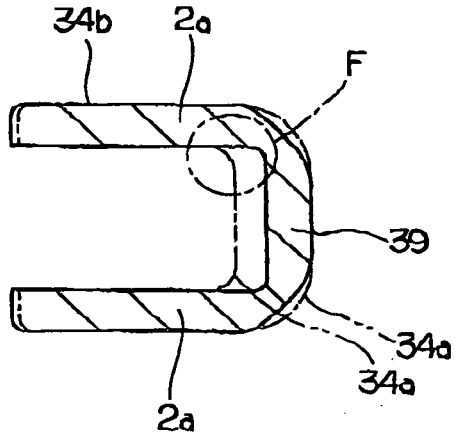
FIG. 12 is a cross-section on E—E of FIG. 11(*a*).
Figure 15:
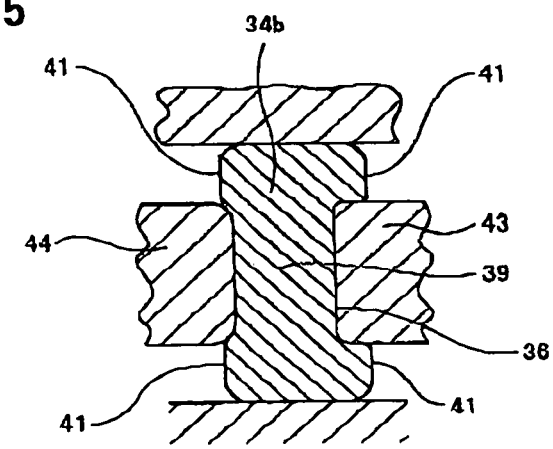
FIG. 15 is a view showing a cross-section portion on G—G of FIG. 11(*a*) in a condition part way through a forging operation of the fourth step.

Next, as a fourth step, the second intermediate blank 34*a* is punched in the horizontal direction in the fixed die 43 (FIG. 15) by the movable die 44 (FIG. 11(*a*) and FIG. 15) of the third forging station. Then, a third cold forging (actual shape) is applied to the second intermediate blank 34*a*, to make a second middle blank 34*b* having a shape and dimension slightly close to the finished product of the rocker arm 1*a*, as shown in FIG. 11 to FIG. 15. In this second intermediate blank 34*b*, a lengthwise middle portion of the base 39 is protruded greatly to the opposite side to the side wall section 2*a*. The lengthwise opposite end portions on one side (the right side in FIG. 11(*a*); the front side in FIG. 11(*b*)) of the base 39 are formed in an approximate shape and dimension of the first and second concavities 36 and 40. Furthermore, in the third forging, the shape and dimensions of the side wall sections 2*a* are adjusted to be approximately the same as for the finished product.

Moreover, in the case of this example, at the opposite side faces of the lengthwise one end portion (the bottom end portion in FIG. 11) of the base 39, the opposite edge portions away in the widthwise direction (the front and back direction in FIG. 11(*a*), the left and right direction in FIG. 11(*b*), and the up and down direction in FIG. 15) from the first concavity 36 for abutting against the tip end portion of the valve body, are made run-offs 41 for material when applying the third cold forging, so that the fixed die 43 and the movable die 44 do not bump into these run-offs 41.

By this construction, it is possible to prevent the addition of excessive load on the fixed die 43 and the movable die 44, so that the life of the dies 43 and 44 can be improved. Therefore, the unit cost at the time of mass production of the rocker arm 1*a* can be reduced. Furthermore, in the case of this example, the run-offs 41 are at the same position as the first concavity 36 in relation to the lengthwise direction of the base 39, and are provided close to the first concavity 36. Therefore, in the case of forming the first concavity 36, the excess thickness can be smoothly allowed to escape, so that the first concavity 36 can be easily and accurately processed to a predetermined shape and dimension.

Furthermore, on the other face (the left face in FIG. 11(*a*), and the back face in 11(*b*)) of the lengthwise other end portion (top end portion in FIG. 11) of the base 39, a position on the opposite side to the second concavity 40 for abutting against the tip end of the lash adjuster, is made a second run-off 42 for material at the time of applying the third cold forging. By means of this construction, the excessive load applied to the fixed die 43 and the movable die 44 can be more effectively prevented.

Moreover, since the position of the base 39 on the opposite side to the second concavity 40 is made the second run-off 42, the second concavity 40 can be easily and accurately processed to a predetermined shape and dimension.

When using the finished product of the rocker arm 1*a*, the opposite end faces of the roller 35 supported on the side wall sections 2*a* may come in contact with the inside faces of these side wall sections 2*a*. Therefore, so that the roller 35 rotates smoothly even if the opposite end faces come in contact with the inside faces in this manner, these inside faces of the side wall sections 2*a* are made flat.

In the case of this example, the shape and dimensions of the second intermediate blank 34*b* are controlled so that even in the case where it is assumed that the second intermediate blank 34*b* and the rocker arm 1*a* are assembled via a support shaft (not shown in the figure), at a position corresponding to the arrangement position of the roller 35 on the rocker arm 1*a* to be obtained (FIG. 1 to FIG. 4), the roller 35 and the base 39 do not interfere with each other. More specifically, as shown in detail in FIG. 14, the middle portion of the inside face of the second intermediate blank 34*b* is formed with an interior end rim of a smooth planar portion 53, which is the inside face of the side wall section 2*a*, and a cylindrical surface portion 54 constituting the middle portion of the inside face of the base 39, continuously connected by a curved portion 55. Furthermore, the shape and dimensions of the inside face of the second intermediate blank 34*b* are controlled so that in the case where it is assumed that the roller 35 is assembled as described above on the inside of the second intermediate blank 34*b*, the roller 35 does not interfere with any of, the smooth planar portion 53, the cylindrical surface portion 54, and the curved portion 55. Moreover, the opposite end faces excluding the chamfers 52 of the roller 35 are positioned further outside (to the left side in FIG. 14) than the interior end rim (point R in FIG. 14) of the smooth planar portion 53 constituting the inside face of the side wall sections 2*a*.

The second intermediate blank 34*b* obtained by this fourth steps is taken out from between the fixed die 43 and the movable die 44 of the third forging station, and is supplied to a first punching station.

Next, as a fifth step, which is a hole forming step carried out at the first punching station, the middle portion of the lengthwise middle portion of the base 39 is subjected to a punching process by means of a hole punch provided on the inside of the fixed die or the movable die, while clamping a portion of the second intermediate blank 34*b*, other than the lengthwise middle portion of the base 39, between the fixed die and the movable die. Preferably, the hole punch is inserted from the side between the two side wall sections 2*a* so that the punch scrap (removed material) is discharged to the opposite side to the side wall section 2*a*. The reason for this is so that the burr produced accompanying the punching process is not directed to the side where the roller 35 is arranged. By means of this punching process, as shown in FIG. 16 to FIG. 19, a hole 45 passing through in the thickness direction is formed in the middle portion, to thus make a third intermediate blank 46.

Furthermore, by forming the hole 45, the first and second two connecting sections 3*a* and 4*a* which connect the lengthwise opposite end portions of the pair of side wall sections 2*a* are formed. Moreover, in the fifth step, at the same time as the punching process, a forging process is applied for adjusting the shape and dimension of the widthwise one edge portion (the right edge portion in FIG. 16(*a*) and FIG. 17; the front side edge portion in FIG. 16(*b*)) of the side wall sections 2*a*. In FIG. 17, the third intermediate blank 46, and a small piece (removed material) 50 produced by punching the base 39 by the punch processing, are shown all together.

Figure 16:
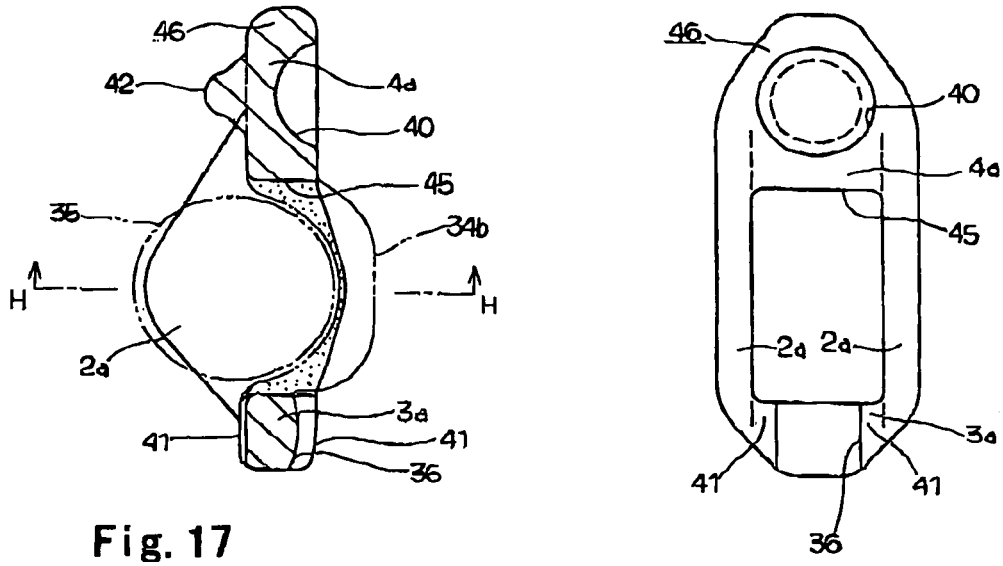
FIG. 16 shows a third intermediate blank obtained by a fifth step, wherein (a) is a cross-section, and (b) is a view seen from the right of (a).
Figure 17:
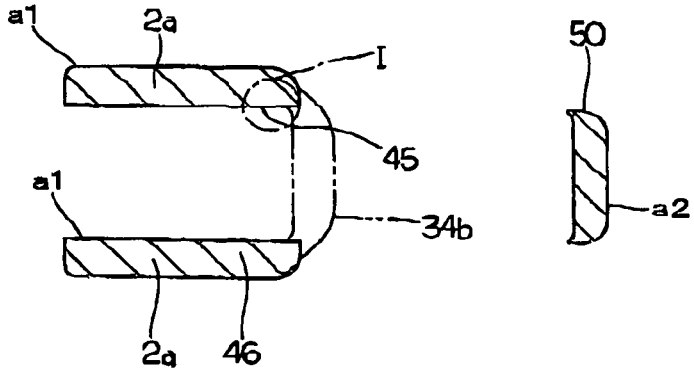
FIG. 17 shows the same third intermediate blank, and a small part which is produced at the time of a punching step of a fifth step, at a cross-section portion H—H of FIG. 16(*a*).
Figure 18:
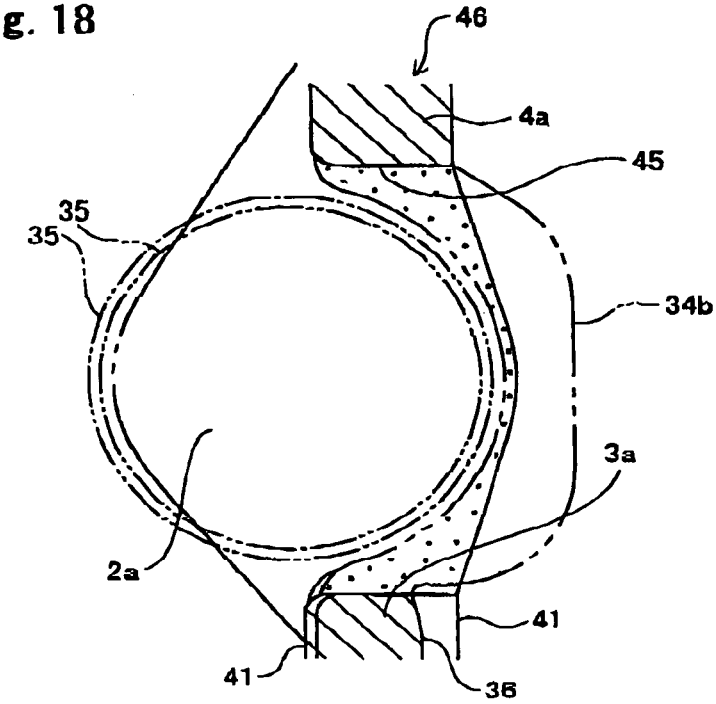
FIG. 18 is a cross-section of an enlarged portion of FIG. 16(*a*).
Figure 19:
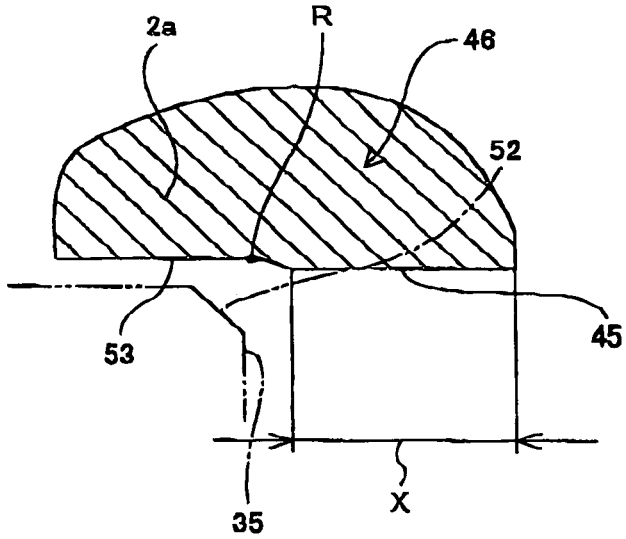
FIG. 19 is a cross-section of an enlarged portion I of FIG. 17.

By forming the hole 45, then at the inner peripheral face of the hole 45 including the portion towards one edge in the widthwise direction (the portion towards the right edge in FIG. 16(*a*), FIG. 14, and FIG. 17 to FIG. 19) of the side wall sections 2*a*, a sheared face (fractured face) is formed on the portion which was connected to the outer peripheral rim of the small piece 50 (the portion shown by the speckled region in FIG. 16 and FIG. 18; the portion with the periphery shown by arrow X in FIG. 19). The third intermediate blank 46 obtained by such a fifth step is taken out from between the movable die and the fixed die of the first punching station, and is supplied to a fourth forging station.

Figure 20:
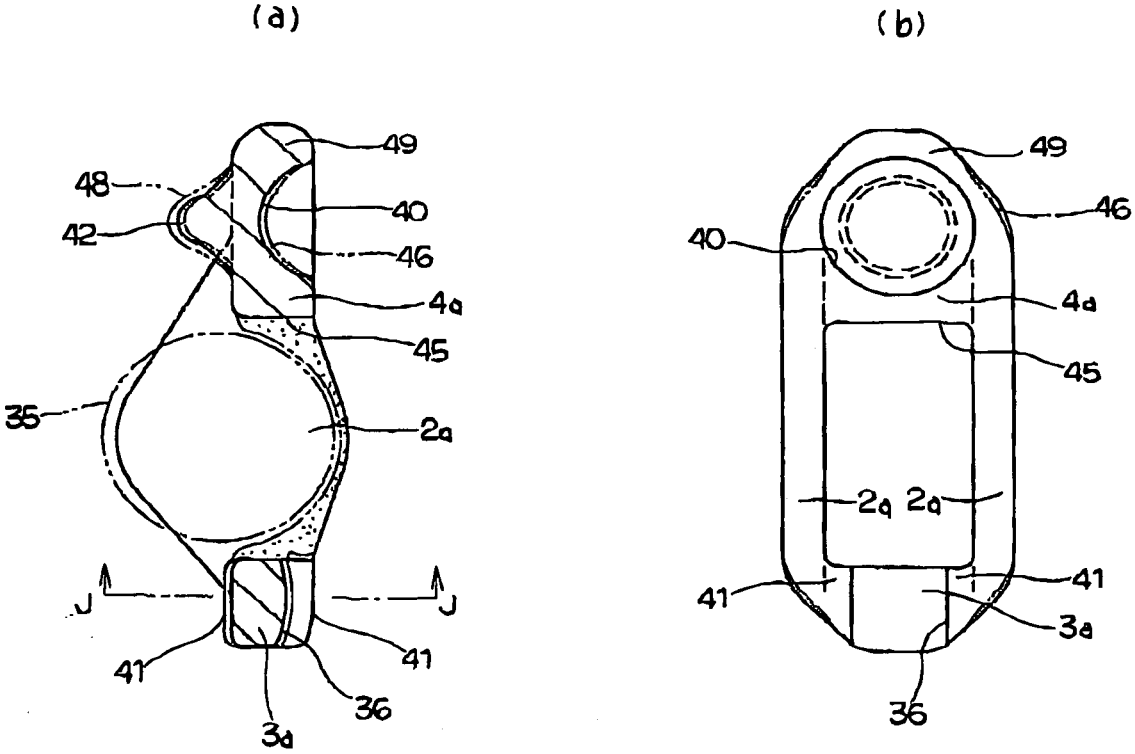
FIG. 20 shows a fourth intermediate blank obtained by a sixth step, wherein (a) is a cross-section, and (b) is a view seen from the right of (a).
Figure 21:
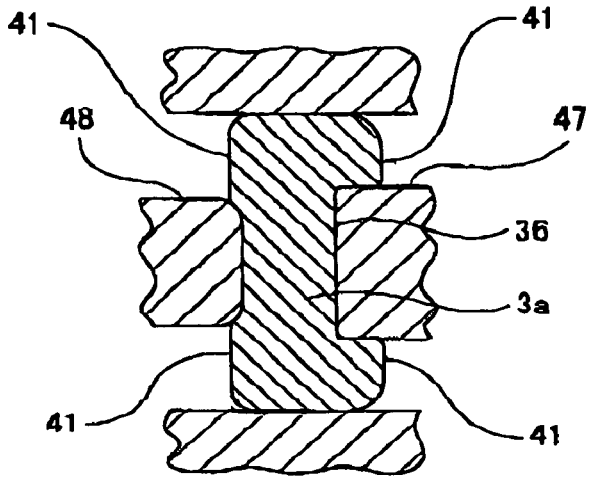
FIG. 21 shows a condition part way through a forging operation of the sixth step, at a cross-section portion J—J of FIG. 20(*a*).
Figure 22:
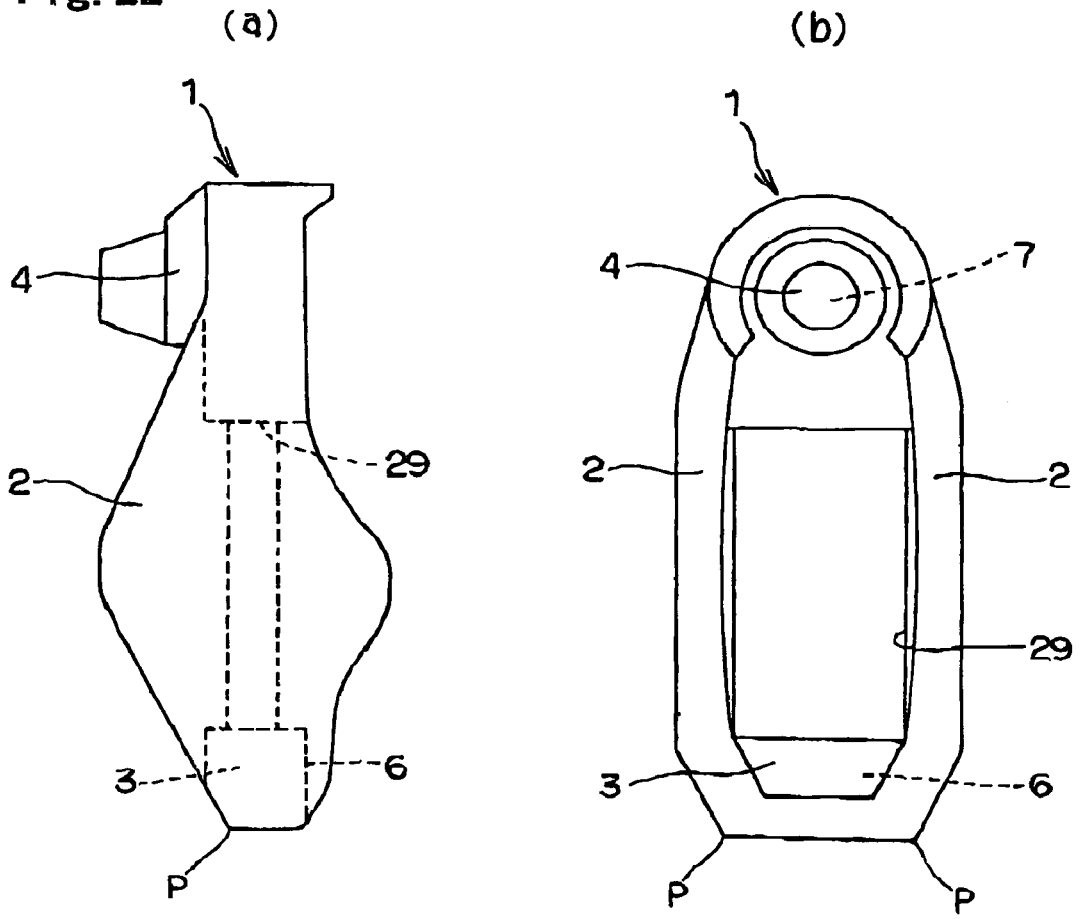
FIG. 22 shows a rocker arm obtained by a conventionally known method of manufacturing a rocker arm, wherein (a) is a front view, and (b) is a view seen from the left of (a).
Figure 23:
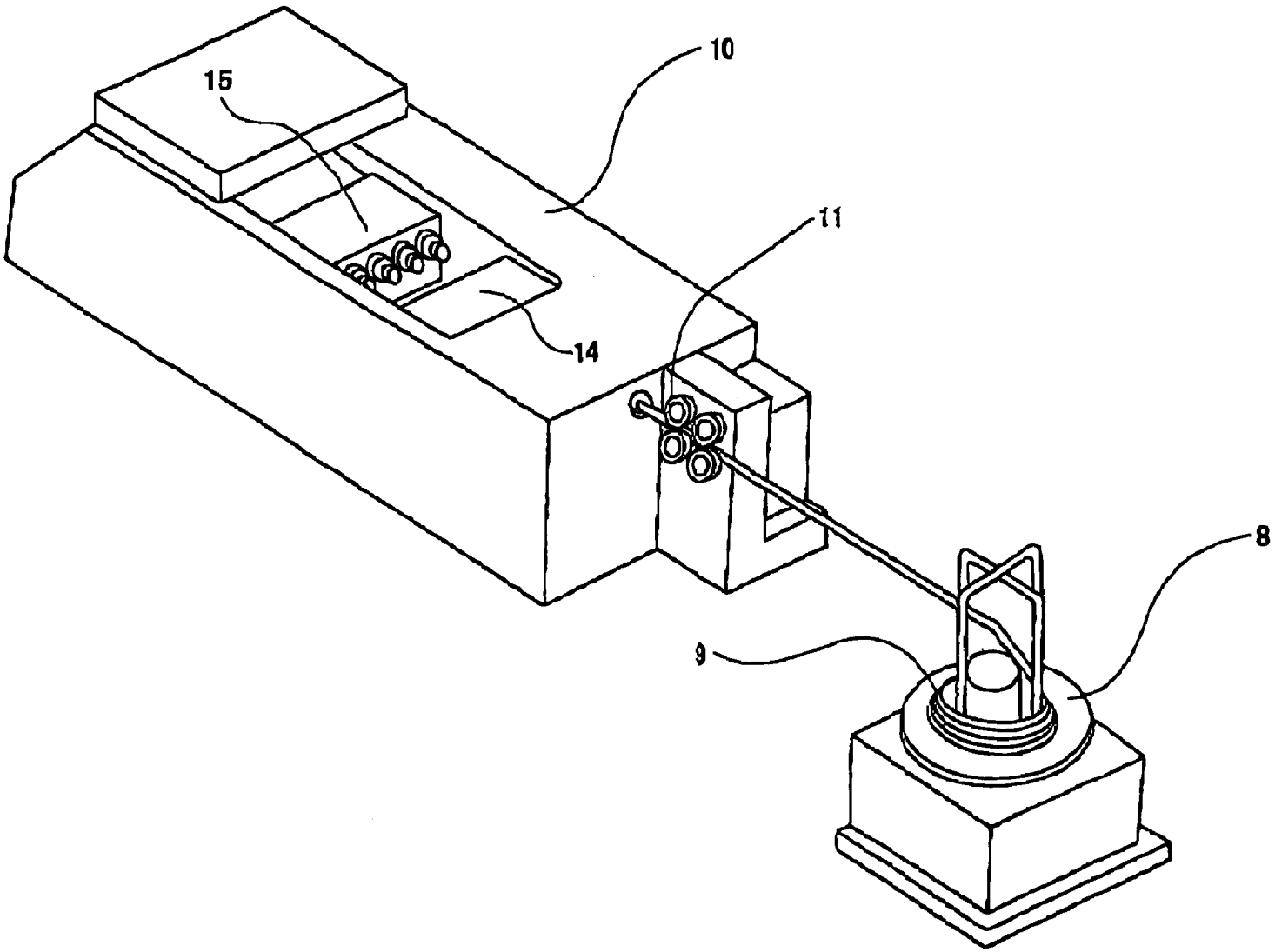
FIG. 23 is a schematic perspective view showing a condition where a rocker arm is manufactured by a conventionally known rocker arm manufacturing method.
Figure 24:
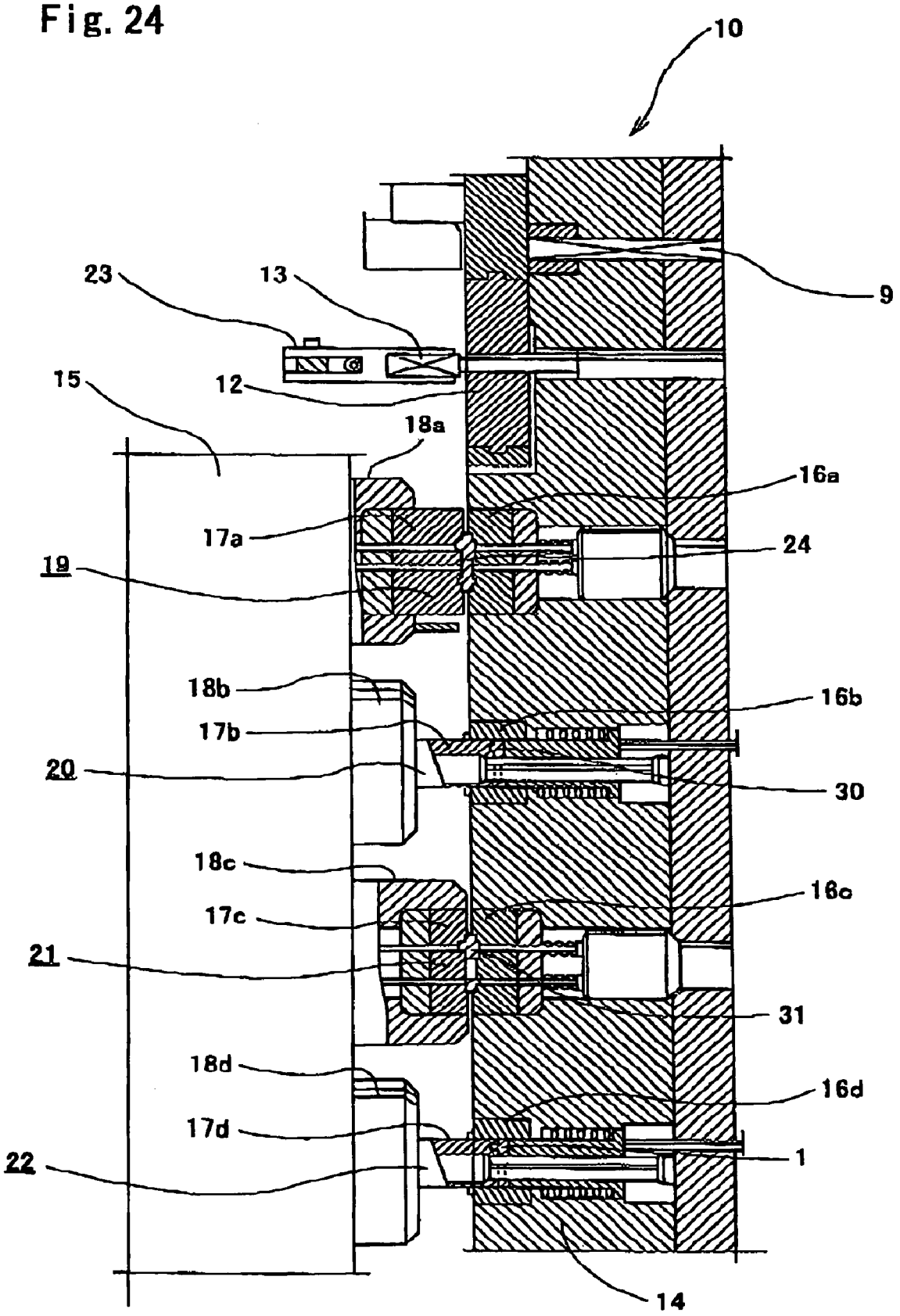
FIG. 24 is a cross-section view of a part of a cold forging machine used in the conventionally known rocker arm manufacturing method.
Figure 25:
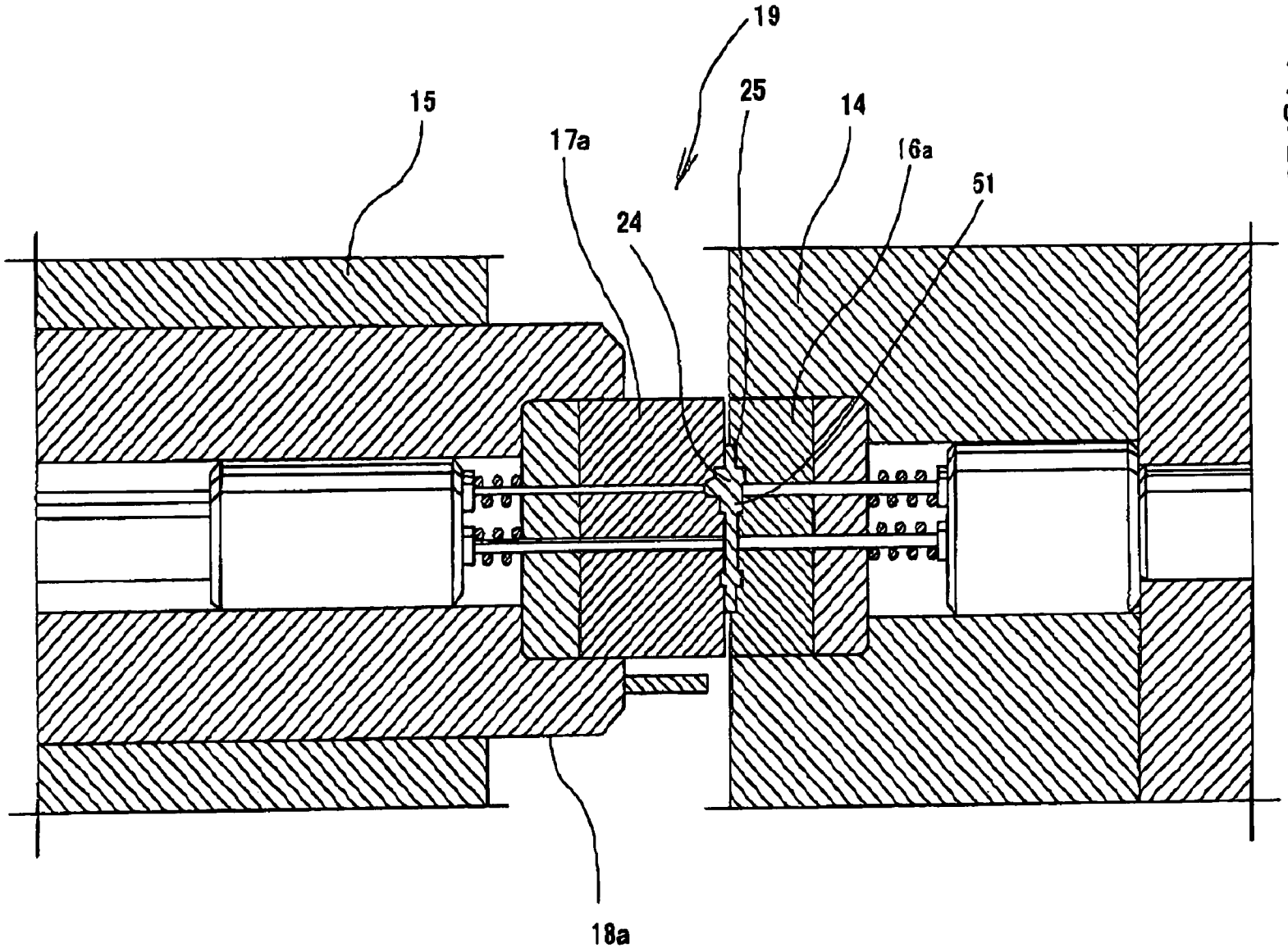
FIG. 25 shows a first forging station of a cold forging machine, being a cross-section of an enlarged portion of FIG. 24.
Figure 26:
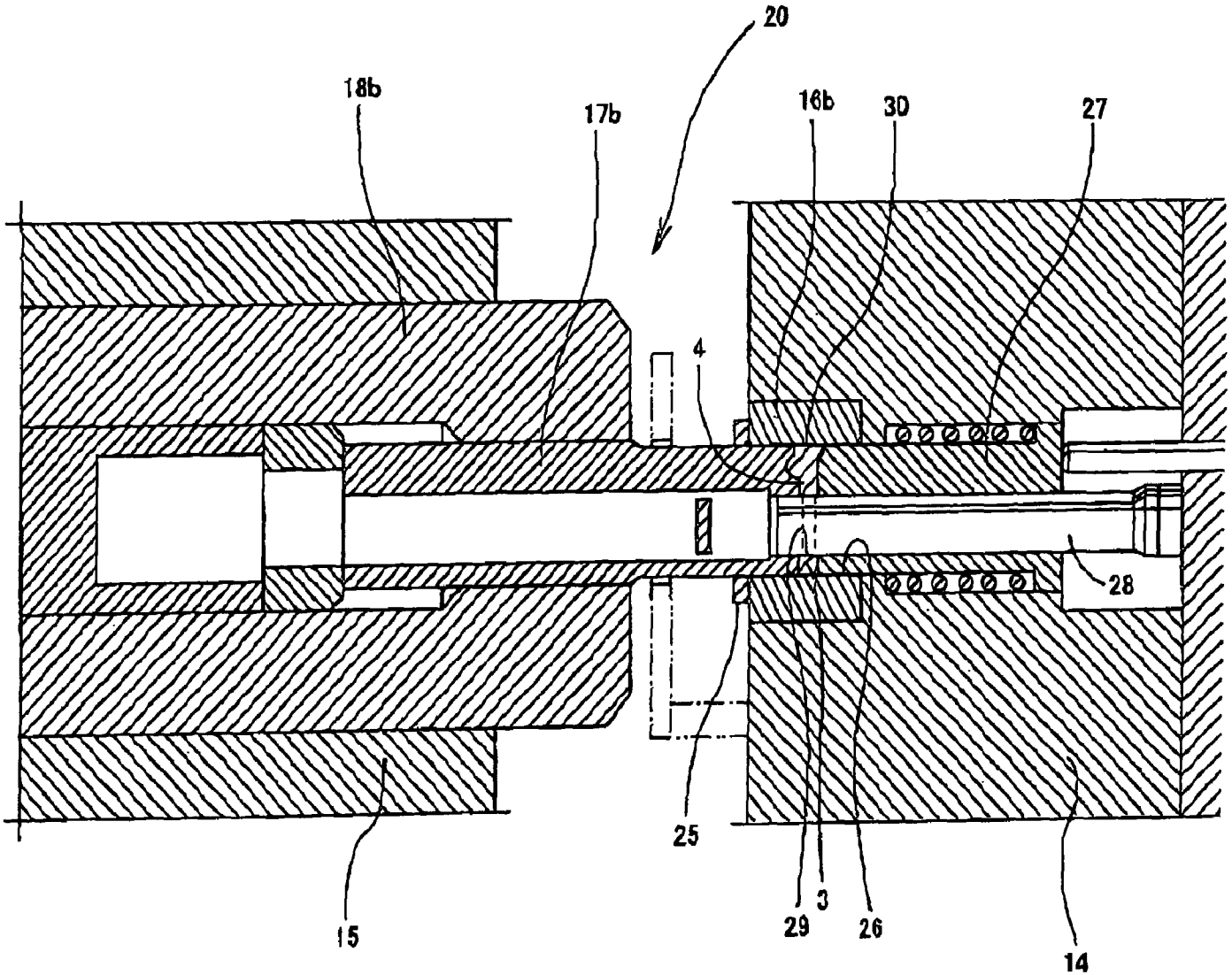
FIG. 26 shows a first punching station of the cold forging machine, being a cross-section of an enlarged portion of FIG. 24.
Figure 27:
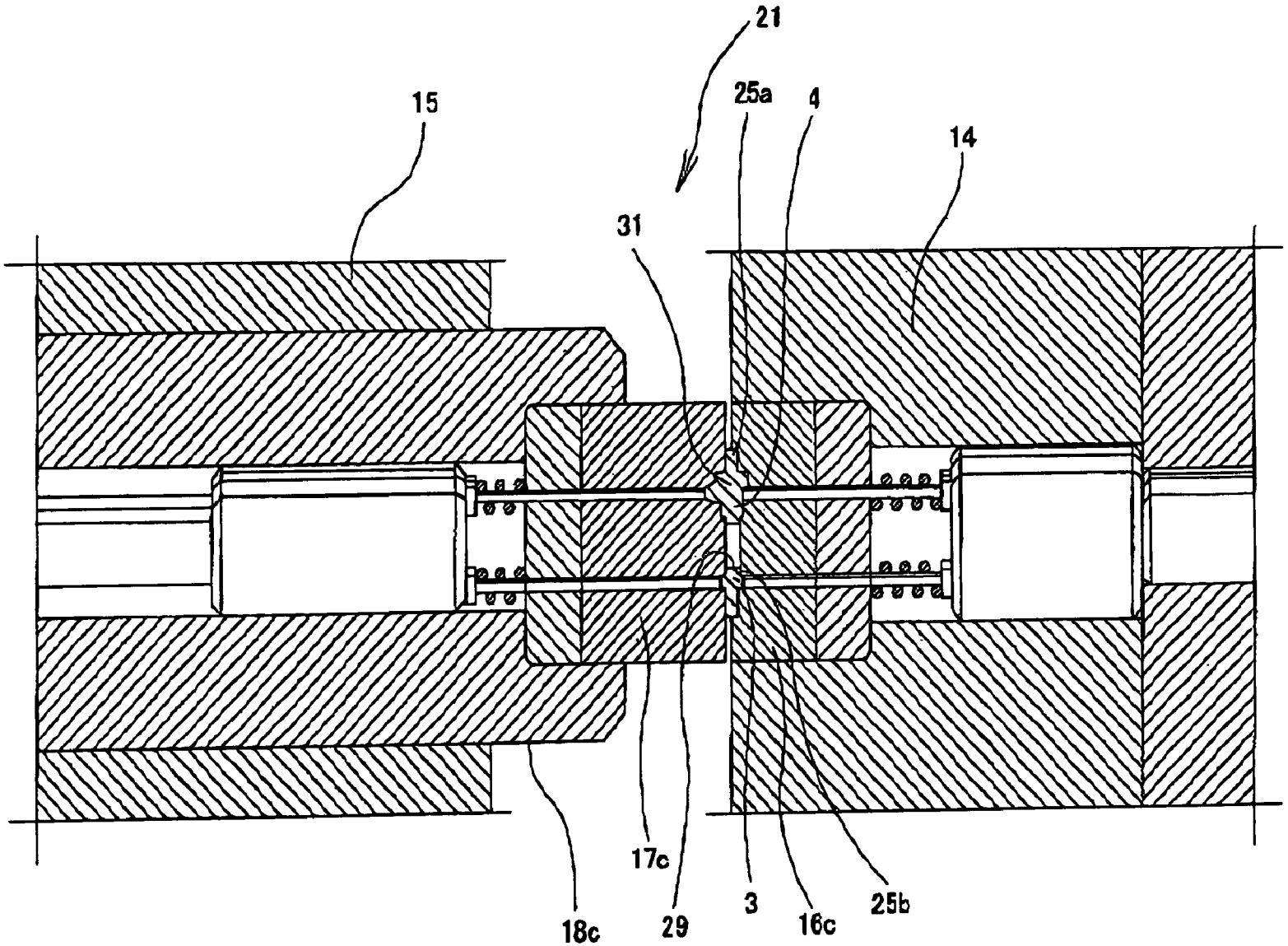
FIG. 27 shows a second forging station of the cold forging machine, being a cross-section of an enlarged portion of FIG. 24.
Figure 28:
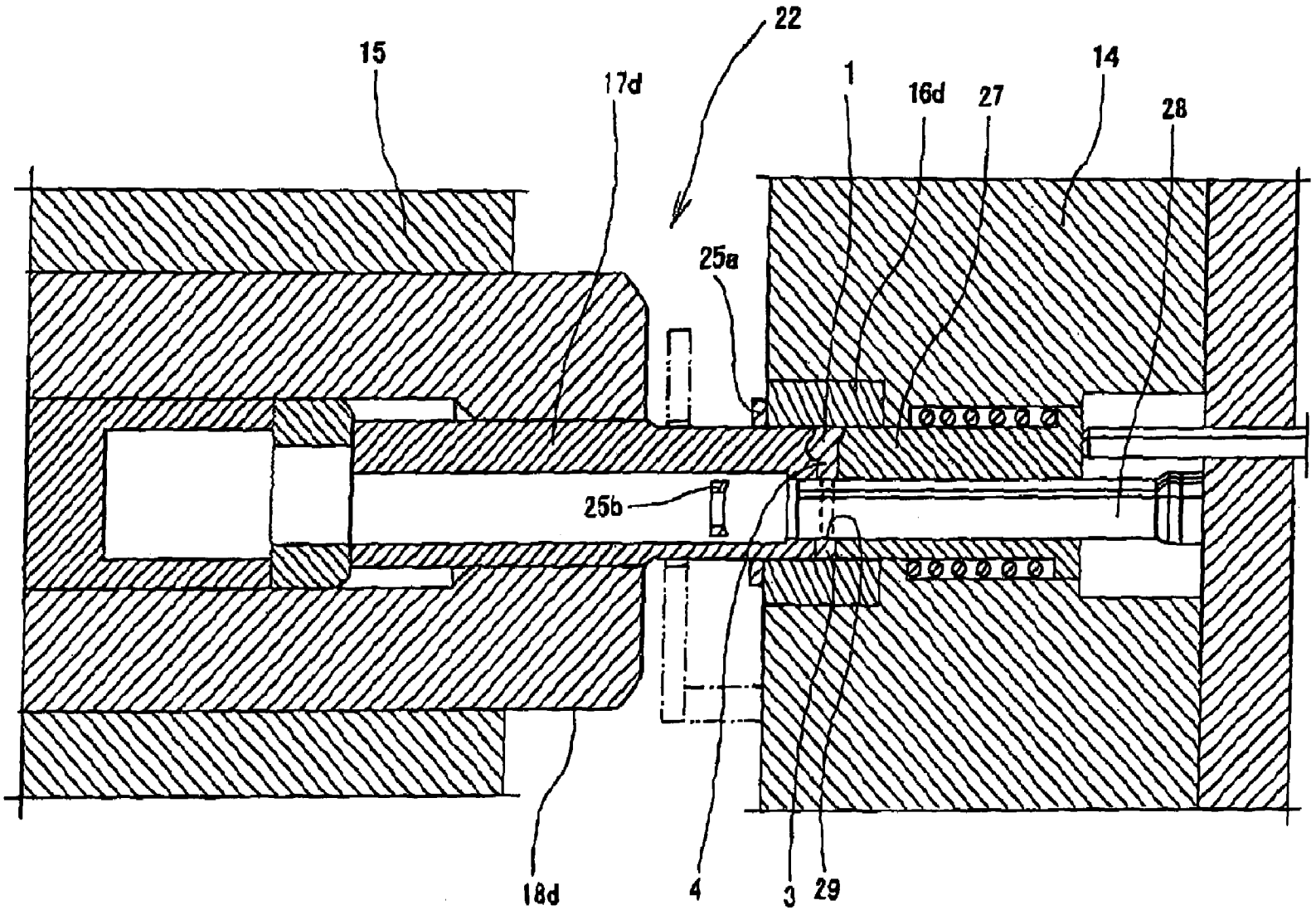
FIG. 28 shows a second punching station of the cold forging machine, being a cross-section of an enlarged portion of FIG. 24.

At the fourth forging station, as a sixth step, as shown in FIG. 20 and FIG. 21, the third intermediate blank 46 is punched in the horizontal direction to the fixed die 47 by the movable die 48, to thereby apply a fourth cold forging (sizing) to the third intermediate blank 46, thus making a fourth intermediate blank 49 as shown in FIG. 20 and FIG. 21 where the first and second concavities 36 and 40 are accurately adjusted to a predetermined shape and dimension.

In the case of this fourth cold forging also, the third intermediate blank 46 is pressed from the same direction as for the case of the second and third cold forgings.

In the case of the fourth cold forging, similarly to the case of the third cold forging, at the opposite side faces of the first connecting section 3*a*, the opposite edge portions away in the widthwise direction (the front and back direction in FIG. 20(*a*), the left and right direction in FIG. 20(*b*), and the up and down direction of FIG. 21) from the first concavity 36 are made run-offs 41 for material when applying the fourth cold forging so that the fixed die 47 and the movable die 48 do not bump against these run-offs 41. By means of this construction, the life of the dies 47 and 48 can be improved, and the first concavity 36 can be easily and accurately processed to a predetermined shape and dimension.

The shape of the fixed die 47, the movable die 48, the run-offs 41, and the second run-off 42 is not limited to the shape shown for this example, and can be changed based on the required product shape.

At the other face of the second connecting section 4*a* (the left face in FIG. 20(*a*), the back face in FIG. 20(*b*)), the position on the opposite side to the second concavity 40 is made the second run-off 42 for material when applying the fourth cold forging. By means of this construction, the life of the dies 47 and 48 can be improved, and the second concavity 40 can be easily and accurately processed to a predetermined shape and dimension.

At the fourth forging station, the step for punching the third intermediate blank 46 in the horizontal direction to the fixed die 47 by the movable die 48 is repeated as necessary, so that at the same time as adjusting the shape and dimension of the first and second concavities 36 and 40, adjustment of the parallelism of the side wall sections 2*a*, or adjustment of the spacing of the inside face pairs or the spacing of the outside face pairs of the side wall sections 2*a* can be also be performed. Moreover, in the case where a turn back is produced in the widthwise one edge portion of the side wall sections 2*a*, then by applying a slight face pressing this turn back can be reduced or can be eliminated. Once this sixth step is completed, the fourth intermediate blank 49 is taken out from between the fixed die 47 and the movable die 48 of the fourth forging station, and this fourth intermediate blank 49 is supplied to the second punching station.

At the second punching station, as a seventh step, a second punching process is applied to one portion of the side wall sections 2*a* of the fourth intermediate blank 49, to thereby make the finished product of the aforementioned rocker arm 1*a* shown in FIG. 1 to FIG. 4. In the case of this example, the second punching process is carried out in the interior of the cold forge forming machine 10. As one method for doing this, a method is considered so that when the fourth intermediate blank 49 is supplied from the fourth forging station to the second punching station, the direction of the fourth intermediate blank 49 is changed by 90 degrees so that the tip end faces of the fixed die and the movable die of the second punching station, and the outside faces of the side wall sections 2*a* face each other. Then the fourth intermediate blank 49 is clamped between the fixed die and the movable die of the second punching station, and the respective circular holes 5 are formed by a hole punch provided on the inside of the fixed die and the movable die. As another method, there is also a method of supplying the fourth intermediate blank 49 from the fourth forging station to the second punching station as is, without the direction being changed, and changing the movement of the drive mechanism (slide mechanism) for reciprocating the movable dies 44 and 48 of the first to fourth forging stations to a direction 90 degrees different to the reciprocating direction by means of cam dies provided on the opposite sides, to thereby form the respective circular holes 5 by a hole punch fitted to these cam dies.

Moreover, in the case of this example, a chamfer 37 (FIG. 4) is formed on the open end peripheral edge portions of the axial outer sides of these circular holes 5 by the forging process, at the same time as the hole forming process for the respective circular holes 5. The finished product of the rocker arm 1*a* obtained in this manner is taken out from the second punching station to a predetermined location by means of an ejection chuck.

In the case of the method of manufacturing a rocker arm of this example constructed as described above, the rocker arm 1*a* is made such that none of the sheared face (fractured face) formed on the inside of the side wall sections 2*a* by the punching process for forming the first and second connecting sections 3*a* and 4*a*, face the opposite end faces of the roller 35. According to the rocker arm 1*a* obtained in this manner, contact between the sheared face (fractured face) and the opposite end faces of the roller 35 can be prevented. Therefore, in a rocker arm 1*a* fitted with the roller 35, the roller 35 can be smoothly rotated. Moreover, the occurrence of abnormal wear of the opposite end faces of the roller 35 can be prevented, and the occurrence of abrasion powder due to this wear of the contact portions can be suppressed. Consequently, improved performance, such as the output performance, of an engine fitted with the rocker arm 1*a* of this example is achieved. Furthermore, in the step after the punching process, it is not necessary to perform the troublesome operation of smoothening the sheared face by face pressing or the like.

In the case of the rocker arm of this example, the lengthwise opposite ends of the side wall sections 2 positioned on the other face (the left side in FIG. 1 and FIG. 3; the back face in FIG. 2) of the first and second connecting sections 3*a* and 4*a*, are arranged in relation to the lengthwise direction, between from the portion α of the first concavity 36 which is to abut against the center of the tip end face of the valve body, up to the portion β of the second concavity 40 which is to abut against the center of the tip end face of the lash adjuster. Therefore, the lengthwise dimension of the side wall sections 2*a* can be shortened, and the volume of the side wall sections 2*a* can be reduced, so that overall lightening of the rocker arm 1*a* is achieved. Hence, the performance of an engine fitted with this rocker arm 1*a* can be further improved. Moreover, in the case of this example, the shape of the first and second connecting sections 3*a* and 4*a* when viewed in the thickness direction, is a trapezoid shape comprising the plurality of straight line sections 56*a*, 56*c* to 56*e*, 56*f* and 56*g*. Therefore, comparing this shape to the case where the middle section of a portion of these straight line portions 56*a*, 56*c* to 56*e*, 56*f* and 56*g* is a circular shape bulging outwards, the volume of the first and second connecting sections 3*a* and 4*a* can be reduced, and the overall rocker arm 1*a* can be further lightened.

The invention according to the second aspect may be applied to a construction where instead of forming the second concavity 40 on the second connecting section 4*a*, a threaded hole is formed in the second connecting section 4*a*, and an adjuster screw is screwed into this threaded hole portion. In this case, for example the lengthwise opposite ends of the side wall sections 2*a* positioned on the one side of the first and second connecting sections 3*a* and 4*e* which is on the opposite side to the first concavity 36, are arranged in relation to the lengthwise direction, between from a portion of the first concavity 36 which is to abut against the center of the base end face of the valve body, up to the center of the screw hole. In the case of such a construction also, similar to the case of this example, the volume of the side wall sections 2*a* can be reduced, and hence overall lightening of the rocker arm is achieved.

In the case of the method of manufacturing a rocker arm of this example constructed as described above, wherein the rocker arm is made by applying cold forging to the blank 32 made from a metal wire rod, the performance of an engine fitted with this rocker arm 1*a* is improved.

That is to say, in the case of this examples as the second step, the first cold forging is applied to the blank 32 by pressing the blank 32 from both sides in the axial direction (the lengthwise direction), and as the third and fourth step, the second and third cold forgings are applied to the first and second intermediate blanks 33 and 34*a*, by pressing the first and second intermediate blanks 33 and 34*a* obtained from the blank 32, from opposite sides in a direction (the thickness direction of the base 39 or of the connecting sections 3*a* and 4*a*) perpendicular to the lengthwise direction. In this manner, the blank 32 and the first and second intermediate blanks 33 and 34*a* are pressed from opposite sides in directions 90 degrees different to each other in the first cold forging, and in the second and third cold forgings. Therefore compared to the case where in all of the cold forgings, the blanks and the intermediate blanks are pressed from opposite sides in the same direction, the concentration of excessive stress at one portion of the obtained rocker arm 1*a* can be suppressed.

In the case where, as with this example, the metal wire rod is made by extrusion forming, the fiber flow of the blank 32 substantially coincides with the lengthwise direction of the blank 32. Furthermore, most of the fiber flow of the intermediate blank 33 obtained from this blank 32 can be made approximately parallel or close to parallel to the lengthwise direction of the intermediate blank 33. In the case of this example, in the third stop and so on, the cold forging is applied to the first intermediate blank 33 etc. by pressing this first intermediate blank 33 etc. from opposite sides in the direction perpendicular to the lengthwise direction. Therefore compared to the case where cold forging is applied to the first intermediate blank 33 etc. by pressing the first intermediate blank 33 etc. from opposite sides in the lengthwise direction, the fiber flow of the obtained rocker arm 1*a* can flow smoothly corresponding to the overall shape of the rocker arm 1*a*. The result of this is that the strength of the obtained rocker arm 1*a* can be sufficiently maintained, and the endurance of an engine provided with this rocker arm 1*a* is improved. Furthermore, in the case of this example, in the third, fourth and sixth steps, when cold forging is applied to the first to third intermediate blanks 33, 34*a* and 46 by pressing these intermediate blanks 33, 34*a* and 46 from opposite sides in the direction perpendicular to the lengthwise direction, the process is set so that the burr (outer burr) at the outer peripheral side does not occur at all. Therefore, different to the case of the aforementioned method of manufacturing a rocker arm disclosed in Patent Document 1, there is no creation of fiber flow in the outer burr portion. Consequently, there is no disturbance of the fiber flow by the outer burr portion, and there is also no cutting of the fiber flow accompanying the removal of the outer burr. Hence, the strength of the finished product (manufactured product) of the rocker arm 1*a* is improved. Furthermore, there is also no occurrence of defects attributable to the sheared face or the fractured face accompanying removal of the outer burr, so that the form accuracy of the rocker arm 1*a* can be made good. Of course, material loss is suppressed, and a reduction in material cost is easily achieved.

Since the process is set so that outer burr does not occur at all when cold forging is applied to the first intermediate blank 33 etc. by pressing the first intermediate blank 33 etc. from opposite sides in a direction approximately perpendicular to most of the fiber flow, or a direction close to this, the contact area between the movable die and the fixed die, and the first intermediate blank 33 etc. is smaller, and the force applied to the first intermediate blank 33 etc. can be made smaller. Hence, formability of the rocker arm 1*a* can be made good, and application of an excessive load to the fixed die and the movable die used in the cold forging can be prevented, so that the life of the fixed die and the movable die can be improved. Consequently, the unit cost at the time of mass production of the rocker arm 1*a* can be reduced. Furthermore, the deformation amount of the respective portions can be reduced, facilitating suppression of work hardening.

In the second step for obtaining the first intermediate blank 33 shown in FIG. 7, the first cold forging is applied to the blank 32 by pressing the blank 32 from opposite sides in the axial direction (the lengthwise direction). Therefore the obtained first intermediate blank 33 can be easily formed in a barrel shape where the diameter at the axial middle portion is increased, as with this example, without increasing the diameter of the metal wire rod. Hence, the second intermediate blank 34*a* having the pair of side wall sections 2*a* of an approximately triangular shape wherein the widthwise dimension at the lengthwise middle portion is a maximum, as with this example, can be easily made from the barrel shape first intermediate blank 33. Moreover, the occurrence of the outer burr can be eliminated. Furthermore, even in the case where the inner burr is produced, this can be kept to a minimum at a position where it does not exert an influence on the product during use. Consequently, a light weight rocker arm 1*a* can be made at low cost. Furthermore, in the case of this example, the fiber flow of the rocker arm 1*a* flows in the lengthwise direction of the overall rocker arm 1*a*. Moreover, this fiber flow is not cut at least at the portions excluding the lengthwise opposite ends, and the inner peripheral face of the hole 45 formed between the first and second connecting sections 3*a* and 4*a*. Therefore, the forming workability can be made good, and the strength and form accuracy is improved.

In the case of this example, the opposite end portions of the support shaft supporting the roller 35 can be crimped in the chamfers 37 (FIG. 4) formed in the outside open end peripheral edges of the through holes 5 formed in the side wall sections 2*a*. More specifically, rim portions made by plastically deforming the opposite end portions of the support shaft radially outward can be engaged with the chamfers 37. Therefore, the opposite end portions of the support shaft can be connected and secured to the respective through holes 5 with sufficient connection strength. As a result, in a cam follower made by assembling the roller 35 with the rocker arm 1*a*, the opposite end portions of the support shaft can be connected and secured with sufficient connection strength to the side wall sections 2*a*, so that the endurance of an engine provided with the rocker arm 1 is improved. Moreover, since the end portion of the support shaft can be inserted inside of one of the through holes 5 while being guided by the chamfer 37, the operation of inserting the support shaft into the through hole 5 can be easily performed. Therefore, a cost reduction is achieved for a cam follower fitted with the support shaft and the roller 35, and the rocker arm 1*a*.

In the case of this example, in the fourth step for obtaining the second intermediate blank 34*b* as shown in FIG. 11, at the time of forming the first and second concavities 36 and 40 by cold forging, at the same position as the first and second concavities 36 and 40 in relation to the lengthwise direction of the base 39 of the second intermediate blank 34*b*, and close to these first and second concavities 36 and 40, there is provided the run-offs 41 and the second run-off 42 for the material. Furthermore, in the sixth step for obtaining the fourth intermediate blank 49 shown in FIG. 20 from the third intermediate blank 46 shown in FIG. 16, when forming the first and second concavities 36 and 40 by cold forming, then at the portion of the third intermediate blank 46, away to the widthwise inside from the pair of side wall sections 2*a*, at the same position in relation to the lengthwise direction as the portion which is to form the first and second concavities 36 and 40, and close to those first and second concavities 36 and 40, there is provided the run-offs 41 and the second run-off 42 for the material. Consequently, when forming the first and second concavities 36 and 40, the excess thickness portion of the second intermediate blank 34*b* and the third intermediate blank 46 can be smoothly allowed to escape, so that these first and second concavities 36 and 40 can be easily and accurately processed to a predetermined shape and dimension. Therefore, the form accuracy and the dimensional accuracy of the first and second concavities 36 and 40 can be made good, so that at the time of using the obtained rocker arm 1*a*, the base end of the valve body and the tip end of the lash adjuster can be accurately engaged at a predetermined position of the rocker arm 1*a*, and performance improvement of an engine provided with the rocker arm 1*a* is obtained. Moreover, since the second run-off 42 is positioned on the opposite side of the base 39 or the second connecting section 4*a* to the second concavity 40, the second concavity 40 can be easily and more accurately processed to a predetermined shape and dimension. Moreover, the addition of an excessive load to the fixed dies 43 and 47, and the movable dies 44 and 48 used in the forging can be prevented, so that the life of the dies 43, 47, 44 and 48 is improved. Therefore, the unit cost at the time of mass production of the rocker arm 1*a* can be further decreased.

In the case of this example, the rocker arm 1*a* is made such that none of the sheared face (fractured face) formed on the inside of the side wall sections 2*a* by the punching process for forming the first and second connecting sections 3*a* and 4*a*, face the opposite end faces of the roller 35. According to the rocker arm 1*a* obtained in this manner contact (rubbing) between the rough sheared face and the opposite end faces of the roller 35 can be prevented. Therefore, in a condition with the roller 35 fitted to the rocker arm 1*a*, the roller 35 can be smoothly rotated. Moreover, the occurrence of abnormal wear of the opposite end faces of the roller 35 can be prevented, and the occurrence of abrasion powder due to this wear of the contact portions can be suppressed. Consequently, improved performance, such as improved output, and improved durability of an engine fitted with this rocker arm 1*a* is achieved. Hence for such performance improvement, it is not necessary to perform the troublesome operation of smoothening the sheared face by face pressing or the like in the step after the punching process.

In the case of this example, as the fifth and sixth steps, the punching process for the base 39, and the forging process for adjusting the first and second concavities 36 and 40 to a predetermined shape and dimension with good accuracy, are carried out by separate steps. Therefore, it is easy to improve the accuracy for the shape and dimension of the concavities 36 and 40.

In the case of this example, the respective circular holes 5 provided in the side wall sections 2*a* are formed by the punching process, but in this invention, the circular holes 5 may be formed by a shaving process or a cutting process instead of the punching process. However, in the case where of these processes, the cutting process is adopted, this becomes a cause of an increase in the cost of the rocker arm 1*a*. Therefore, from the aspect of reducing the cost for the rocker arm 1*a*, the circular holes 5 are preferably formed by the punching process or the shaving process, and more preferably the circular holes 5 are formed by the punching process. Furthermore, the intermediate blank taken out from the cold forge forming machine 10 may be transported to another press working machine, and the punching process for the circular holes 5 then can be carried out at this press working machine.

In the case of this example, a lubricating film layer of a zinc phosphate film or the like is formed beforehand on the metal wire rod. However, by spreading a lubricant on the inside face of the die of the cold forge forming machine 10, and supplying the lubricant to the interior of the cold forge forming machine 10, the friction between the outside of the blank 32 and the first to fourth intermediate blanks 33, 34*a*, 34*b*, 46 and 49, and the inside face of the dies can also be suppressed.

Figure 29:
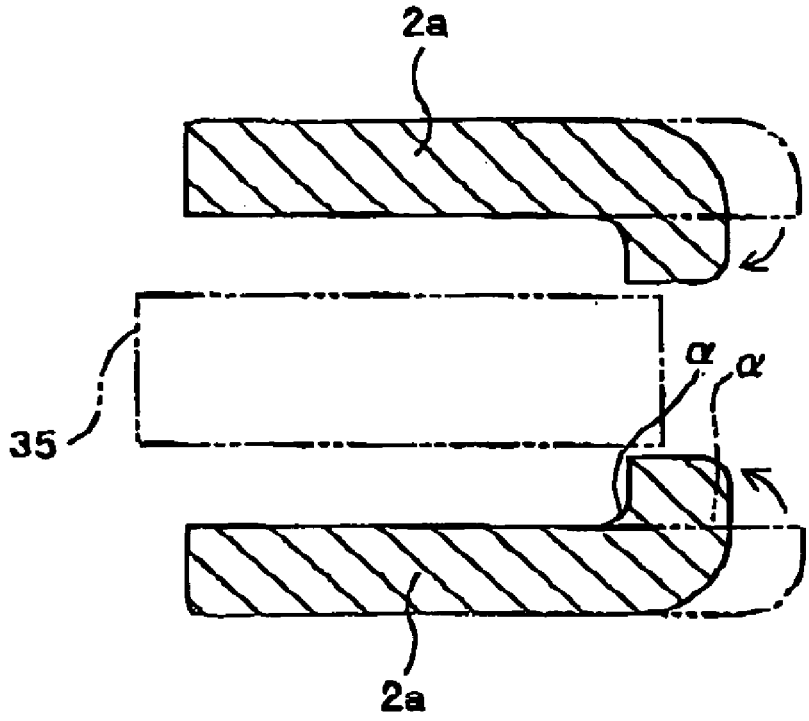
FIG. 29 shows a first example of another manufacturing method for obtaining a rocker arm in which a sheared face and a fractured face do not face the opposite end faces of a roller, at a cross-section portion H—H of FIG. 16.

In the case of this example, the rocker arm 1*a* is made so that the whole of the sheared face (fractured face) formed on the inside face of the side wall sections 2*a* does not face the opposite end faces of the roller 35. Therefore as the fourth step for applying the third forging to the second intermediate blank 34*a* to make the second intermediate blank 34*b* (FIG. 11 to FIG. 15), the shape and the dimensions of the second intermediate blank 34*b* are controlled so that even in the case where it is assumed that the roller 35 is arranged at a position corresponding to the arrangement position of the roller 35 of the rocker arm 1*a* to be obtained, on the inside of the second intermediate blank 34*b*, the roller 35 and the base 39 do not interfere. However, the manufacturing method for obtaining a rocker arm 1*a* as described above wherein the whole of the sheared face (fractured face) formed on the inside face of the side wall section 2*a* does not face the opposite end faces of the roller 35, is not limited to the method of this example. For example, as a first example of another manufacturing method for obtaining this rocker arm 1*a*, after a fifth step for applying punch processing to the base 39 of the second intermediate blank 34*b* to make the third intermediate blank 46 (FIG. 16 to FIG. 19), then as shown in FIG. 29, the portion formed with the sheared face (fractured face) (the portion shown by a in FIG. 29) on the inside face at the widthwise one edge portion (the right edge portion in FIG. 29) of the side wall sections 2*a* due to the punch processing, may be subjected to cold forging to bend back in the sideways direction (the up and down direction in FIG. 29) of the side wall sections 2*a* as shown by the arrows in FIG. 29.

Figure 30:
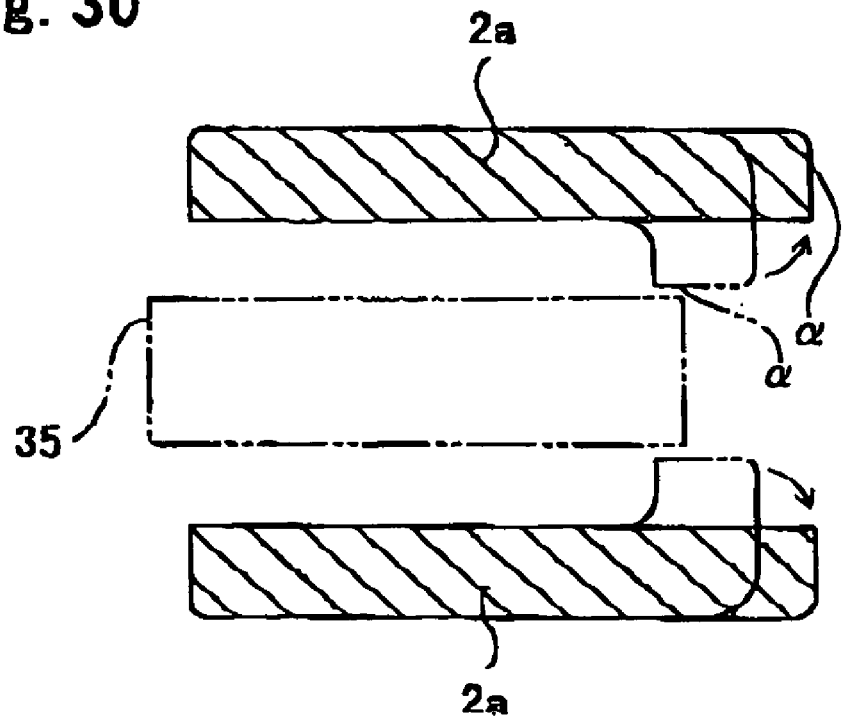
FIG. 30 shows a second example of another manufacturing method for obtaining a rocker arm in which a sheared face and a fractured face do not face the opposite end faces of a roller, at the cross-section portion H—H of FIG. 16.

As a second example of another manufacturing method for obtaining the rocker arm 1*a*, after the fifth step for applying punch processing to the base 39 of the second intermediate blank 34*b* to make the third intermediate blank 46, then as shown in FIG. 30, the portion formed with the sheared face (fractured face) (the portion shown by a in FIG. 30) on the inside face at the widthwise one edge portion (the right edge portion in FIG. 30) of the side wall sections 2*a* due to the punch processing, may be subjected to cold forging for plastically deforming by burring or the like so as to be directed in the widthwise direction (the left and right direction in FIG. 30) of the side wall sections 2*a* as shown by the arrows in the FIG. 30. According to the method of manufacturing a rocker arm as shown in FIG. 29 and FIG. 30, in the case where it is assumed that the roller 35 is arranged at a position corresponding to the arrangement position of the roller 35 of the rocker arm 1*a* to be obtained, on the inside of the second intermediate blank 34*b* which is to be subjected to punch processing, obtained by the fourth step, then even if the roller 35 and the base 39 interfere with each other, the whole of the sheared face (fractured face) does not face the opposite end faces of the roller 35.

Since the present invention is manufactured and operated as described above, the performance of an engine provided with the rocker arm is improved.

In a separate aspect of the present invention, in relation to the embodiment of FIG. 1 to FIG. 4, by providing a second step for obtaining a first intermediate blank 33 of a predetermined shape, as a step before the third step for obtaining the second intermediate blank 34*a* having the rough shape and dimensions of the rocker arm 1*a*, a light weight rocker arm 1*a* can be made at low cost.

In the case of this example, in the second step, in the case where the cross-section area of the first intermediate blank 33 in relation to a virtual plane perpendicular to the axial direction, at the maximum diameter portion 38 where the diameter of the first intermediate blank 33 (FIG. 7) is a maximum, is made $S_1$ (FIG. 7(*b*)), the first intermediate blank 33 is processed to a predetermined shape and dimension so that $S_1$ satisfies a predetermined relation. That is to say, of the pair of side wall sections 2*a* constituting the finished product of the rocker arm 1*a* to be obtained, at the position in relation to the lengthwise direction, corresponding to the maximum diameter portion 38 of the first intermediate blank 33, the sum of the areas of the cross-section shapes $a_1$ (FIG. 17) in relation to a virtual plane perpendicular to the lengthwise direction, is made $S_2$. Furthermore, in a fifth step, at the position in relation to the lengthwise direction (the front and back direction in FIG. 17)), corresponding to the maximum diameter portion 38 of the first intermediate blank 33, of the small chip 50 (FIG. 17) obtained by punching the base 39 in the punching processing, the area of the cross-section shape $a_2$ (FIG. 17) in relation to a virtual plane perpendicular to the lengthwise direction, is made $S_3$. Then in this case, the shape and dimension of the first intermediate blank 33 is controlled so as to satisfy the relationship $S_1 \geqq S_2+S_3$.

In the case of this example, a diameter $d_{38}$ (FIG. 7(*a*)) at the maximum diameter portion 38 of the first intermediate blank 33 is made approximately the same as a distance $L_1$ (FIG. 2) between the outside face pairs of the two sidewall sections 2*a* at the position corresponding to the maximum diameter portion 38 in relation to the lengthwise direction, of the pair of sidewall sections 2*a* (FIG. 1 to FIG. 4) which constitute the finished product of the rocker arm 1*a* to be obtained ($d_{38} \approx L_1$). Furthermore, in the case of this example, the axial overall length $L_{38}$ (FIG. 7(*a*)) of the first intermediate blank 33 is made approximately the same size as the overall length $L_2$ (FIG. 2) of the rocker arm 1*a* to be obtained ($L_{38} \approx L_2$).

In the case of the method of manufacturing a rocker arm of this example constructed as described above, a lightweight rocker arm 1*a* can be made at low cost. That is to say, in the case of this example, since a manufacturing process which can manufacture the rocker arm 1*a* using the multistage cold forge forming machine is established, then automation of the manufacturing is facilitated, so that workability is excellent, and manufacturing time can be shortened. Therefore manufacturing cost can be greatly reduced. Furthermore, in the case of this example, for the second step, the first cold forging is applied to the blank 32 of a predetermined length, to make a barrel shape first intermediate blank 33 for which the diameter is a maximum at an axial middle portion. Next, as the third step, the second cold forging is applied to the barrel shape first intermediate blank 33, to make a second intermediate blank 34*a* having a rough shape and dimension of the rocker arm 1*a*. Therefore, as with this example, the side wall sections 2*a* constituting the rocker arm 1*a* are a shape where the widthwise dimension becomes smaller from near the lengthwise center towards the opposite lengthwise ends, and made an approximate triangle shape though, the shape of the first intermediate blank 33 to be subjected to the second cold forging can be made close to the shape of the second intermediate blank 34*a* to be obtained by the second cold forging. That is to say, the shape of the first intermediate blank 33, as with the case of the second intermediate blank 34*a*, can be made a shape where the cross-section area in relation to the direction perpendicular to the lengthwise direction becomes smaller from near the lengthwise center towards the opposite lengthwise ends. Furthermore, since the side wall sections 2*a* are an approximate triangular shape, lightening of the rocker arm 1*a* is achieved while enabling formation of the circular holes 5 for supporting the opposite ends of the support shaft. Consequently, in the case of this example, a lightweight rocker arm 1*a* can be obtained, and the occurrence of the burr to be removed can be eliminated. In this manner, since each process is established, and the shape of the blank 32 and the intermediate blanks 33, 34*a*, 34*b*, 46, and 49 is set so as not to produce the burr, a reduction in material cost is achieved, and none of the process for removing the burr and the removal mechanism for this, nor the mechanism for discharging the removed burr are required, so that the structure of the dies for the cold forge forming machine 10 can be simplified.

Furthermore, in the second cold forging, the plastic deformation of the first intermediate blank 33 can be minimized. Therefore it is possible to prevent an excessive load being applied to the dies used in the cold forging, and the endurance of the dies can thus be increased. Hence, the unit cost when mass manufacturing the rocker arm 1*a* can be decreased. Furthermore, since the first intermediate blank 33 can be formed in a barrel shape by compressing in the axial direction, as in this example, then for the metal wire rod for obtaining the rocker arm 1*a*, one with a small diameter can be used. As a result, a lightweight rocker arm 1*a* can be made at low cost. Since the first intermediate blank 33 is symmetrical about the central axis, then at the time of forging, it is not necessary to restrict the phase (of the rotation direction) in relation to the central axis of the first intermediate blank 33.

Furthermore, in the case of this example, in the case where: the cross-section area related to the maximum diameter portion 38 of the first intermediate blank 33 obtained in the second step, is $S_1$; the total of the cross-section areas at a position corresponding to the maximum diameter portion 38 of the pair of side wall sections 2*a* which constitute the rocker arm 1*a* to be obtained, is $S_2$; and the cross-section area at the position corresponding to the maximum diameter portion 38, for a small piece 50 which is obtained by punching the base 39 in a punching process in the fifth step, is $S_3$, then these cross-section areas are made so as to satisfy the relationship $S_1 \geqq S_2+S_3$. Therefore, in the third step, when performing the second cold forging, each portion of the first intermediate blank 33 can be plastically deformed while extruding the material from near the maximum diameter portion 38 of the first intermediate blank 33 towards other portions, so that formability can be made good. Furthermore, since the cross-section of the first intermediate blank 33 is controlled in this manner, so that a shortage of material at part of the sidewall sections 2*a* can be prevented.

Moreover, in the case of this example, the diameter $d_{38}$ at the maximum diameter portion 38 of the first intermediate blank 33 is made approximately the same as the distance $L_1$ between the outside face pairs of the two sidewall sections 2*a* at the position corresponding to the maximum diameter portion 38 in relation to the lengthwise direction, of the pair of sidewall sections 2*a* which constitute the finished product of the rocker arm 1*a* to be obtained ($d_{38} \approx L_1$). Therefore in the second cold forging, the plastic deformation of the first intermediate blank 33 can be minimized, so that the application of an excessive load to the dies used in the cold forging can be more effectively prevented, and the endurance of the dies can be improved. Therefore, the unit cost at the time of mass production of the rocker arm 1*a* can be further reduced. Moreover, since the width $L_1$ and the diameter $d_{38}$ at the maximum diameter portion are made substantially the same, the first intermediate blank 33 can be controlled in the thickness direction (the left and right direction in FIG. 2) of the side wall sections 2*a*, at the time of the second cold forging, so that the shape accuracy can be made good.

In the case of this example, the axial overall length $L_{38}$ (FIG. 7(*a*)) of the first intermediate blank 33 is made approximately the same size as the overall length $L_2$ (FIG. 2) of the rocker arm 1*a* to be obtained ($L_{38} \approx L_2$). Therefore in the second cold forging, the positioning in the axial direction of the first intermediate blank 33 can be easily performed. Hence addition of an excessive load or an unbalanced load on the dies used for the cold forging can be more effectively prevented, so that the endurance of the dies can be improved. Furthermore, the form accuracy of the rocker arm 1*a* can be made good.

In the present example, since the above described construction is used, a light weight rocker arm can be obtained at low cost.

INDUSTRIAL APPLICABILITY

Lightening of a rocker arm obtained by applying cold forging to a blank made of metal wire rod is achieved, and performance of an engine provided with this is improved.

What is claimed is:

1. A method of manufacturing a rocker arm, the rocker arm comprising a pair of side wall sections provided with a space therebetween;

a first connecting section and a second connecting section which connect corresponding portions near lengthwise opposite ends of the two side wall sections; and a pair of mutually concentric circular holes formed in the pair of side wall sections at mutually matching positions, wherein the first and second connecting sections have engagement sections which engage with a valve body and a rocking support member, the method comprising the steps of:

(a) obtaining a starting blank by cutting a metal wire rod to a predetermined length, (b) making a first intermediate blank by applying cold forging to the starting blank by pressing the starting blank from lengthwise opposite sides; and (c) making a second intermediate blank by applying cold forging to the first intermediate blank by pressing the first intermediate blank from opposite sides which are perpendicular to the lengthwise direction.

2. A method of manufacturing the rocker arm according to claim 1 further comprising the steps of:

controlling step (a) by making the first intermediate blank so that the cross-sectional area is changed in the lengthwise direction corresponding to a change in the cross-sectional area in the direction perpendicular to this longitudinal direction, in relation to the lengthwise direction of the rocker arm to be obtained by applying cold forging to the starting blank by pressing the starting blank from lengthwise opposite sides; and controlling applying cold forging to the first intermediate blank by pressing the first intermediate blank from opposite sides in a direction perpendicular to the lengthwise direction to prevent a flash on the outer peripheral side.

3. A method of manufacturing a rocker arm, the rocker arm comprising a pair of side wall sections provided with a space therebetween;

a first connecting section and a second connecting section which connect corresponding portions near lengthwise opposite ends of the pair of side wall sections; and a pair of mutually concentric circular holes formed in the pair of side wall sections at mutually matching positions, wherein the first and second connecting sections have engagement sections which engage with a valve body and a rocking support member;

the method comprising the steps of:

(a) applying cold forging to a starting blank which is obtained by cutting a metal wire rod to a predetermined length, (b) making a first intermediate blank by applying cold forging to the starting blank by pressing the starting blank from lengthwise opposite the longitudinally opposed sides;

(c) forming a run-off portion when one of the first engagement section and_the second engagement section is formed in one of step (a) and step (b), the run off portion being formed from portions which are away toward the inside in a widthwise direction from the pair of side wall sections, at least one portion being at a same position in relation to the lengthwise direction as a portion which is to form one of the first engagement section and the second engagement section; wherein the run-off portion is not struck by a die used in the cold forging.

4. A method of manufacturing a rocker arm, the rocker arm comprising a pair of side wall sections provided with a space therebetween;

a first connecting section and a second connecting section which connect corresponding portions near lengthwise opposite ends of the pair of side wall sections; and a pair of mutually concentric circular holes formed in these two side wall sections at mutually matching positions, wherein the first and second connecting sections have engagement sections which engage with a valve body and a rocking support member, the method comprising the steps of:

(a) applying cold forging to a starting blank which is obtained by cutting a metal wire rod to a predetermined length, (b) making an first intermediate blank by applying cold forging to the starting blank by pressing the starting blank from lengthwise opposite the longitudinally opposed sides;

(c) forming the circular holes in the side wall sections by simultaneously forming the chamfers on the outside open end portions of the circular holes;

(d) forming a run-off portion when one of the first engagement section and the second engagement section is formed in one of step (a) and step (b) the run off portion being formed from portions which are oriented to the inside in a widthwise direction from the pair of side wall sections, at least one portion being at a same position in relation to the lengthwise direction as a portion which is to form one of the first engagement section and the second engagement section wherein the run-off portion is not struck by a die used in the cold forcing.

5. A method of manufacturing a rocker arm, the rocker arm comprising a pair of side wall sections provided with a space therebetween; and a pair of connecting sections which connect corresponding portions near the lengthwise opposite ends of the pair of side wall sections, wherein the connecting sections have engagement sections which engage with a valve body and a rocking support member, the method comprising the steps of:

applying a first cold forging to a starting blank which is obtained a by cutting a metal wire rod having a circular cross-section to a predetermined length, making a first intermediate blank with a cross-section area changed in relation to the axial direction, corresponding to a change in the cross-section area related to the lengthwise direction of the rocker arm to be obtained, applying at least a second cold forging to the first intermediate blank, to thereby make a second intermediate blank provided with a base which connects the pair of side wall sections and one portion pairs of the side wall sections; and applying a hole forming process for forming a circular hole in a lengthwise middle portion of the base of the second intermediate blank to make a third intermediate blank provided with a pair of connecting sections.

6. A method of manufacturing a rocker arm according to claim 5, wherein the first intermediate blank made by applying the first cold forging to the blank is a barrel shape with the diameter maximum at an axial middle portion.

7. A method of manufacturing a rocker arm according to claim 5 wherein a cross-sectional area of the first intermediate blank related to a virtual plane perpendicular to the axial direction at a maximum diameter portion where the diameter of the first intermediate blank becomes a maximum is $S_1$; the total of cross-section areas related to a virtual plane perpendicular to the lengthwise direction at a position corresponding to a maximum diameter portion of the first intermediate blank in relation to the lengthwise direction, of the pair of side wall sections which constitute the rocker arm to be obtained is $S_2$; and a cross-section area in relation to the virtual plane perpendicular to the lengthwise direction, at a position corresponding to a maximum diameter portion of the first intermediate blank in relation to the lengthwise direction, of a small piece which is produced in a hole forming process by punching the base in a punching process being the hole forming process is $S_3$, then the shape and dimension of the first intermediate blank is controlled so as to satisfy the relationship $S_1 \geqq S_2+S_3$.

8. A method of manufacturing a rocker arm according to claim 5, wherein the diameter of the maximum diameter portion of the first intermediate blank is approximately the same as a distance between the outside face pairs of the two side wall sections, at a position corresponding to the maximum diameter portion in relation to the lengthwise direction, of the pair of side wall sections which constitute the rocker arm to be obtained.

9. A method of manufacturing a rocker arm according to claim 5, wherein the length in the axial direction of the first intermediate blank and the overall length of the rocker arm to be obtained are approximately the same size.

* * * * *